US009838769B2

(12) United States Patent
Kauffman et al.

(10) Patent No.: US 9,838,769 B2
(45) Date of Patent: Dec. 5, 2017

(54) MICROPHONE SHIELD

(71) Applicants: Mark A. Kauffman, Indianapolis, IN (US); Benjamin A. Carlisle, Indianapolis, IN (US); Mark Henderson, Indianapolis, IN (US); Andrew Symons, Indianapolis, IN (US); Eric T. Smith, Indianapolis, IN (US)

(72) Inventors: Mark A. Kauffman, Indianapolis, IN (US); Benjamin A. Carlisle, Indianapolis, IN (US); Mark Henderson, Indianapolis, IN (US); Andrew Symons, Indianapolis, IN (US); Eric T. Smith, Indianapolis, IN (US)

(73) Assignee: Auralex Acoustics, Indianapolis, IN (US)

( * ) Notice: Subject to any disclaimer, the term of this patent is extended or adjusted under 35 U.S.C. 154(b) by 0 days.

(21) Appl. No.: 15/255,972

(22) Filed: Sep. 2, 2016

(65) Prior Publication Data

US 2017/0070800 A1 Mar. 9, 2017

Related U.S. Application Data

(60) Provisional application No. 62/214,058, filed on Sep. 3, 2015.

(51) Int. Cl.

| | |
|---|---|
| ***G10K 11/16*** | (2006.01) |
| ***H04R 1/08*** | (2006.01) |
| ***G10K 11/162*** | (2006.01) |

(52) U.S. Cl.
CPC ..... *H04R 1/086* (2013.01); *G10K 11/162* (2013.01)

(58) Field of Classification Search
CPC ..... H04R 1/086; G10K 11/162
USPC ..... 181/284
See application file for complete search history.

(56) References Cited

U.S. PATENT DOCUMENTS

| | | | | | |
|---|---|---|---|---|---|
| 4,967,874 | A * | 11/1990 | Scalli | H04R 1/086 | 181/158 |
| 4,975,966 | A * | 12/1990 | Sapiejewski | H04R 1/38 | 181/151 |
| 8,069,946 | B1 * | 12/2011 | Cruise, III | H04R 1/28 | 181/198 |
| 8,191,678 | B2 * | 6/2012 | Zou | G10K 11/168 | 181/284 |
| 8,646,571 | B2 * | 2/2014 | Aliev | G10K 11/16 | 181/198 |
| 2002/0139066 | A1 * | 10/2002 | Szymanski | E04B 1/8209 | 52/145 |

* cited by examiner

*Primary Examiner* — Forrest M Phillips
(74) *Attorney, Agent, or Firm* — Barnes & Thornburg LLP

(57) ABSTRACT

Various configurations of a microphone shield are disclosed. Each of the microphone shields includes a number of panels configured to be positioned around a point in space at which a microphone may be positioned. Acoustic liners may be coupled to the panels. At least one of the panels and/or acoustic liners is configured to define an arc that is convex in shape relative to the point in space.

12 Claims, 20 Drawing Sheets

MICROPHONE SHIELD

This application claims priority under 35 U.S.C. §119 to U.S. patent application Ser. No. 62/214,058, which was filed on Sep. 3, 2015 and is expressly incorporated herein by reference.

TECHNICAL FIELD

The present disclosure relates generally to an apparatus to minimize noise at a microphone, more particularly, to a microphone shield positioned near a microphone during use.

BACKGROUND

The dual purpose of a microphone shield is to block reverberant energy from the room boundaries behind and to the sides of the microphone, while absorbing any sound that enters the device from the rear.

The current state of the art for portable, rigid, stand mounted microphone shields uniformly consists of curved, concave (when viewed from the inside of the device) and/or flat faceted designs that encircle the microphone on three sides. They are all lined with acoustically absorbent material, typically open cell polyurethane foam, or in some cases a layer of nonwoven fibers. The purpose of this absorptive lining is to reduce the level of any internal reflections that may occur from the shell of the shielding device itself caused by direct sound entering the open portion of the shell. This energy can be reflected directly back at the microphone causing unwanted sonic colorations.

There are two design approaches to the structural shell that surrounds the microphone and supports the absorptive material, perforated and solid. The shells that are perforated do a poor job of isolating the microphone from ambient room reflections but to a large degree do not have any, or as much, internal reflections. Solid shells do a much better job of isolating the microphone from the acoustical influence of the room but their mostly semi-circular or concave shape (when viewed from the inside) tend to reflect some level of acoustical energy back to the microphone.

SUMMARY

According to one aspect, a microphone shield is disclosed. The microphone shield includes a number of panels configured to be positioned around a point in space at which a microphone may be positioned. The shield may also include a number of acoustic liners that are coupled to the panels. Each liner has a geometric profile on the surface facing the point at which the microphone may be positioned. At least one of these sound-facing surfaces is configured to define an arc that is convex in shape relative to the point in space. In some embodiments, at least one of the panels of the shield may be configured to define an arc that is convex in shape relative to the point in space.

BRIEF DESCRIPTION OF THE DRAWINGS

The detailed description particularly refers to the following figures, in which:

FIGS. 27A-C illustrate a number of attachment mechanisms for the microphone shield of FIG. 27.

DETAILED DESCRIPTION OF THE DRAWINGS

Figure 1:
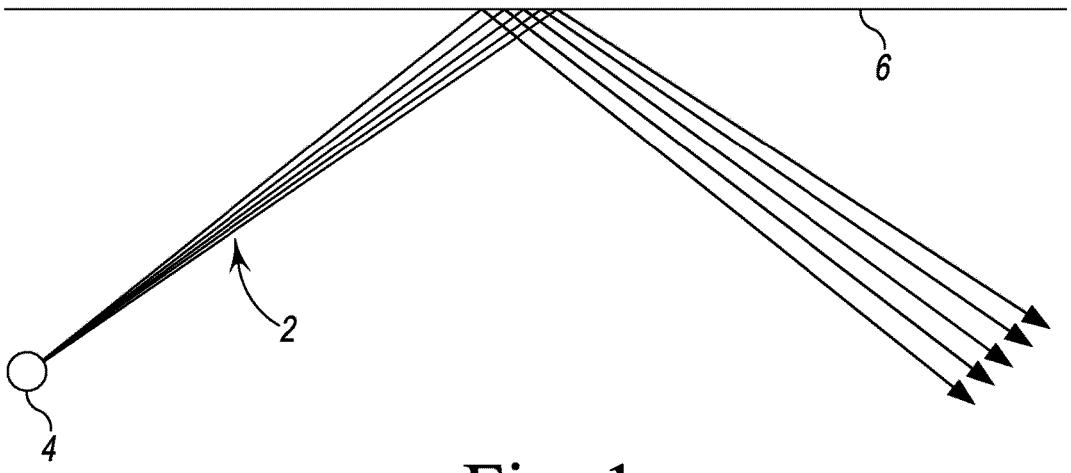
FIG. 1 is a simplified diagram of radiating energy reflecting from a smooth, flat surface.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, sound waves 2 generated by a sound source 4 radiate outward from the source 4. When the waves 2 encounter a substantially smooth wall or surface 6 with no diffusing material, the waves 2 are reflected. As shown in FIG. 1, the reflected waves 2 remain relatively concentrated. If the waves 2 are reflected back toward a microphone, the concentration of the waves adds some amount of undesired spectral coloration to the recorded audio signal.

Figure 2:
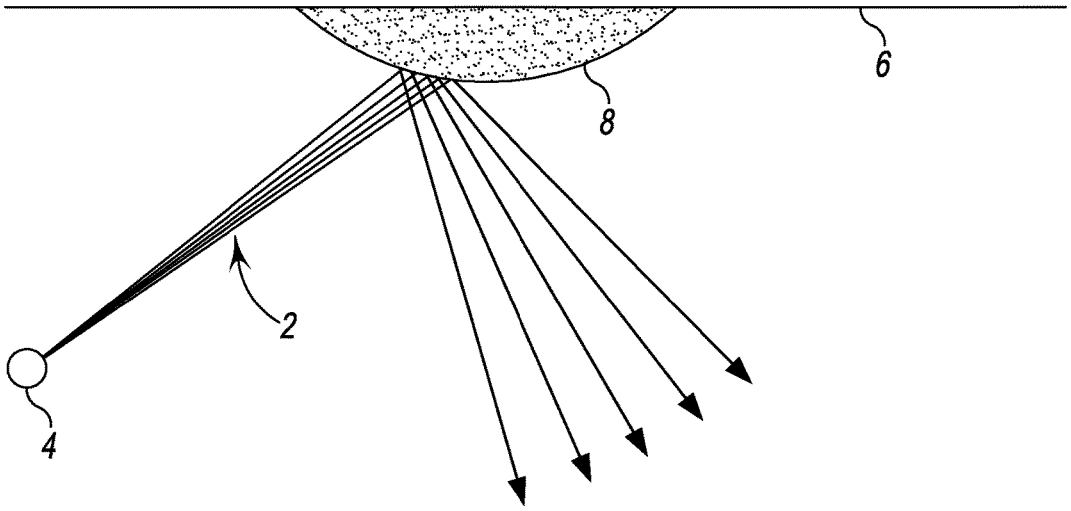
FIG. 2 is a simplified diagram of radiating energy reflecting from a diffusing convex surface.

A microphone shell, by necessity needs to wrap around the rear and sides of the microphone as much as possible to shield the microphone from back and sidewall room reflections. The resulting curved or arced shape of shell can cause energy or waves that do make it into the shell to be focused toward the microphone. Most of this is mitigated by the absorptive lining inside of the shell but not all of this energy is absorbed. This adds some amount of undesired spectral coloration to the recorded audio signal. As shown in FIG. 2, a convex profile 8 of the inside surfaces of the panels distributes this unabsorbed or reflected waves over a wider angle instead of focusing or concentrating it at the microphone location.

Figure 3:
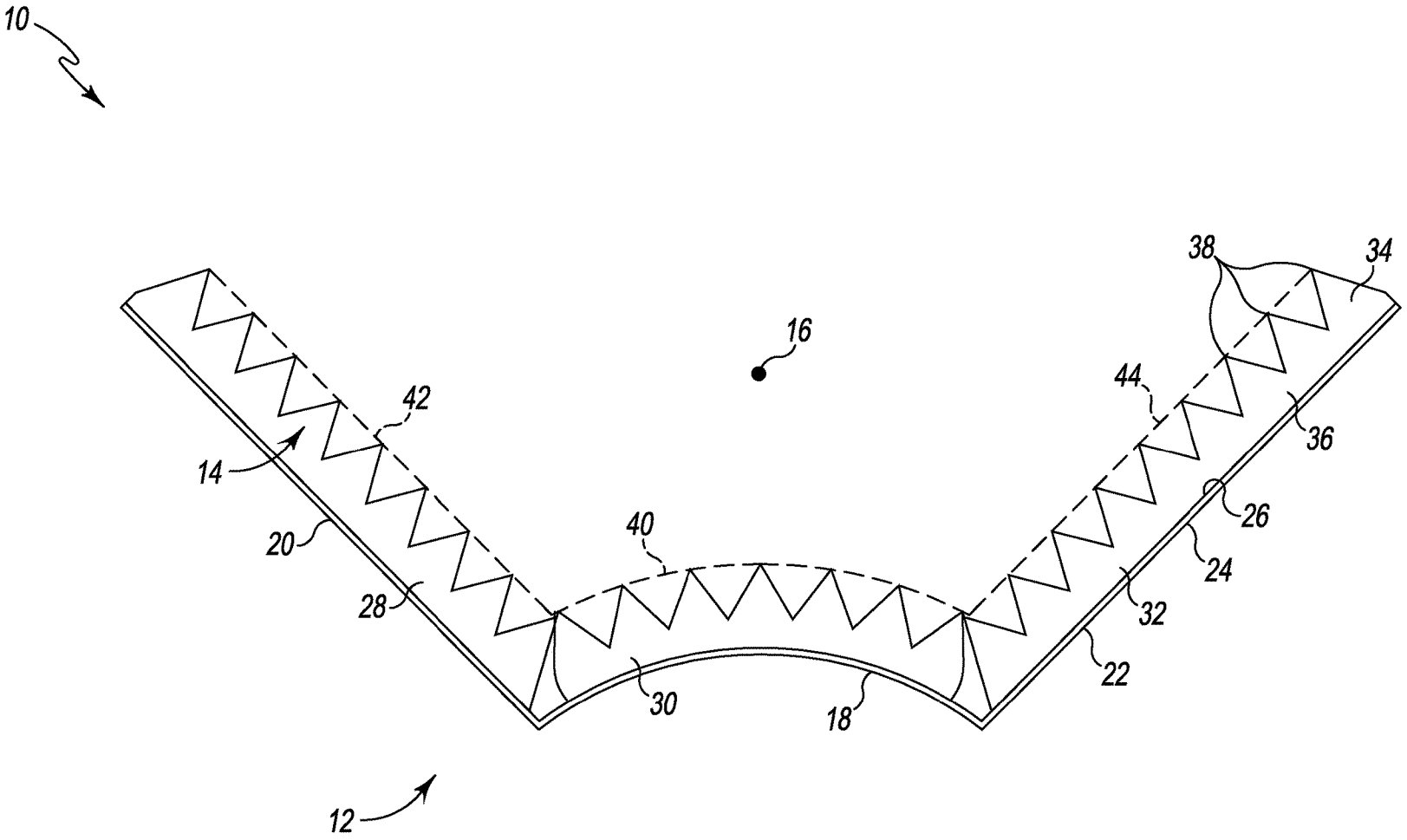
FIG. 3 is a top plan view of an embodiment of a microphone shield, this embodiment defining a single convex arc facing a central point.

Referring to FIG. 3, a microphone shield 10 comprising a shell 12 and acoustic liner 14 is shown. The illustrative microphone shield 10 curves around a point 16. In use, a microphone (not shown) is positioned at or near the point 16, and the microphone shield is configured to block/absorb unwanted reflected sound energy before it reaches the microphone. The illustrative shell 12 includes a central panel 18, a first outer panel 20, and a second outer panel 22. In some embodiments, the shell 12 includes more or less supports than those shown in FIG. 3. Each of the panels 18, 20, 22 include a first surface 24 facing away from the point 16 and a second surface 26 facing towards the point 16. In the illustrative embodiment shown in FIG. 3, the central panel 18 is arced such that the second surface 26 of the central panel 18 is a convex surface facing the point 16. Such a convex second surface 26 of the central support is configured to act as a diffuser of sound energy.

Acoustic liners 28, 30, 32 are coupled to the second surface 26 of each panel 18, 20, 22. In the illustrative embodiment, the acoustic liners 28, 30, 32 are made of an acoustically absorbent material, such as, for example, open cell polyurethane foam, or a layer of nonwoven polyester fibers. The acoustic liners 28, 30, 32 include a geometric profile 34. In the illustrative embodiment, the geometric profile 34 is that of a series of triangles extending the height of the acoustic liners 28, 30, 32. In other embodiments, the acoustic liners may include number of different geometric profiles, such as, for example, a series of triangles extending across the width of an acoustic liner, a series of semi-circles extending the height of an acoustic liner, a series of squares extending the height of an acoustic liner, a series of pyramids repeating across the area of an acoustic liner, a series of squares repeating in a checkered pattern across the area of an acoustic liner, where a first square extends a first height away from a support and a second square extends a second height away from the support, such that the first height is different than the second height.

Each acoustic liner 28, 30, 32 extends from a panel-facing surface 36 configured to couple to the second surface 26 of a panel 18, 20, 22, and terminates in one or more sound-facing surfaces 38. In the illustrative embodiment, the one or more sound-facing surfaces 38 are one or more tips of the triangle of the geometric profile 34. Additionally, the one or more sound-facing surfaces 38 of each acoustic liner 28, 30, 32 are configured to define an arc. In the illustrative embodiment, the sound-facing surfaces 38 of the central acoustic liner 28 form a central arc 40 that is convex in shape, relative to the point 16; the sound-facing surfaces 38 of the first acoustic liner 30 form a first arc 42 that is straight in shape; and the sound-facing surfaces 38 of the second acoustic liner 32 form a second arc 44 that is straight in shape.

Figure 4:
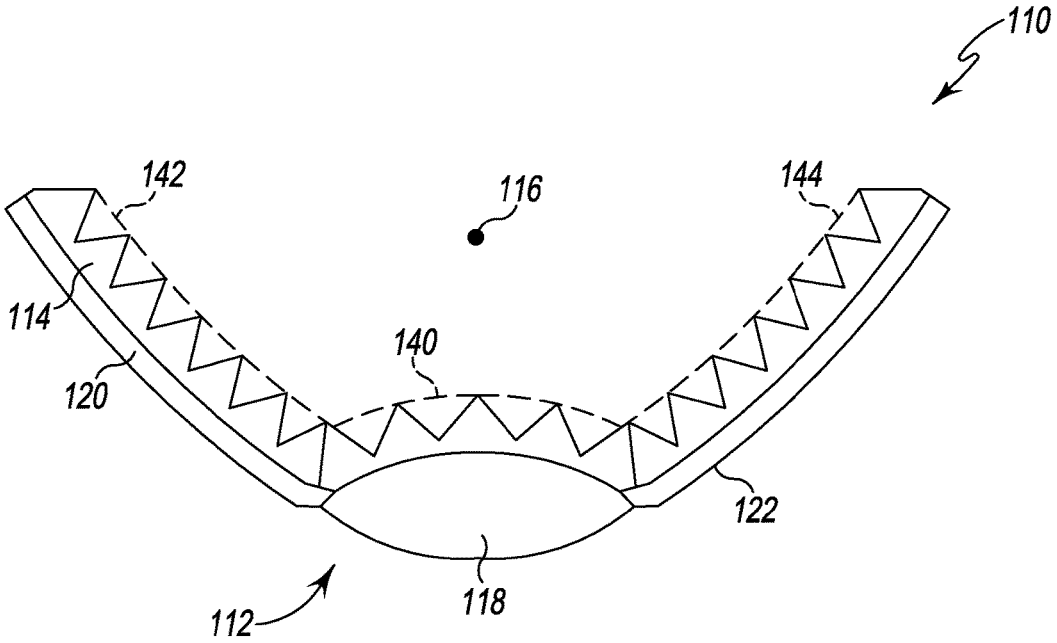
FIG. 4 is a top plan view of another embodiment of a microphone shield.

Referring to FIG. 4, an embodiment of the microphone shield 110 having a shell 112 and acoustic liners 114, curved around a point 116 (i.e., the microphone location) is shown. The microphone shield 110 is similarly embodied as the microphone shield 10 of FIG. 3. As such, parts with similar numbering serve similar functions, and full descriptions of those parts are not repeated here.

As shown in FIG. 4, a central panel 118 of the microphone shield is arced such that a second surface 126 of the central panel 118 forms convex shape, relative to a point 116. Each of a first panel 120 and a second panel 122 are arced such that their respective second surfaces 126 form a concave shape, relative to the point 116.

Additionally, each of the sound-facing surfaces 138 of the acoustic liners 128, 130, 132 are configured to define an arc. A central arc 140 formed by the microphone shield 110 is a convex shape, relative to the point 116. A first arc 142 and a second arc 144 formed by the microphone shield 110 is concave in shape, relative to the point 116.

Figure 5:
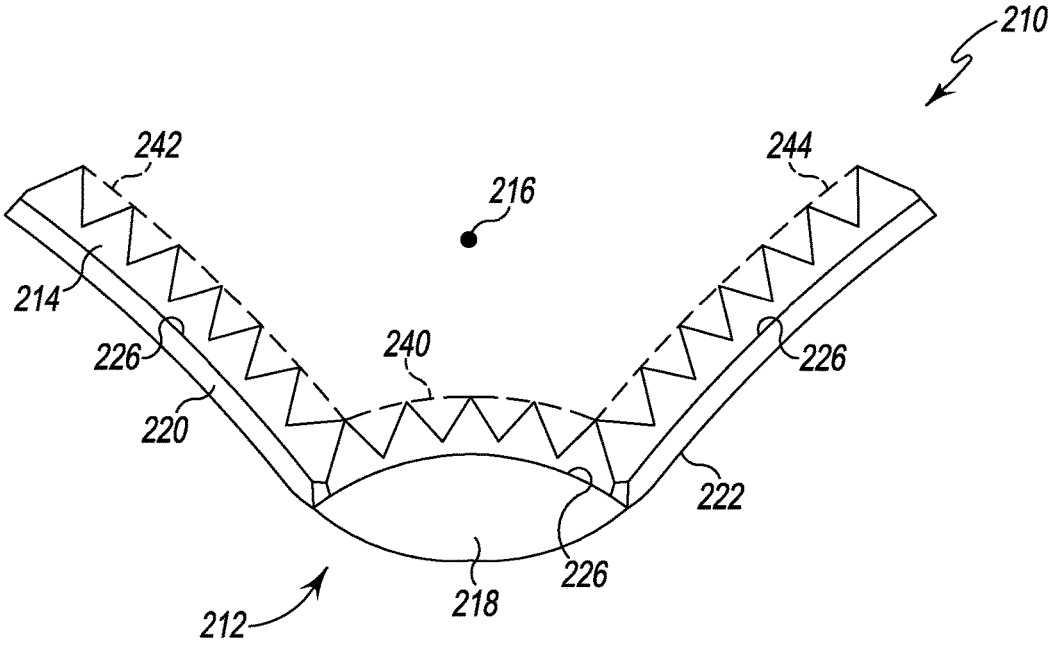
FIG. 5 is a top plan view of another embodiment of a microphone shield, this embodiment defining multiple convex arcs facing a central point.

Referring to FIG. 5, an embodiment of the microphone shield 210 having a shell 212 and acoustic liners 214, curved around a point 216 is shown. The microphone shield 210 is similarly embodied as the microphone shield 10 of FIG. 3. As such, parts with similar numbering serve similar functions, and full descriptions of those parts are not repeated here.

As shown in FIG. 5, a central panel 218 of the microphone shield is arced such that a second surface 226 of the central panel 218 forms convex shape, relative to a point 216 (i.e., the microphone location). Each of a first panel 220 and a second panel 222 are arced such that their respective second surfaces 226 also form a convex shape, relative to the point 216.

Additionally, each of the sound-facing surfaces 238 of the acoustic liners 228, 230, 232 are configured to define an arc. A central arc 240 formed by the microphone shield 210 is a convex shape, relative to the point 216. A first arc 242 and a second arc 244 formed by the microphone shield 210 is convex in shape, relative to the point 216. Arcs 240, 242, 244 are configured to diffuse sound energy reflected by the panels of the shell 212 and not fully absorbed by the acoustic liners 228, 230, 232.

Figure 6:
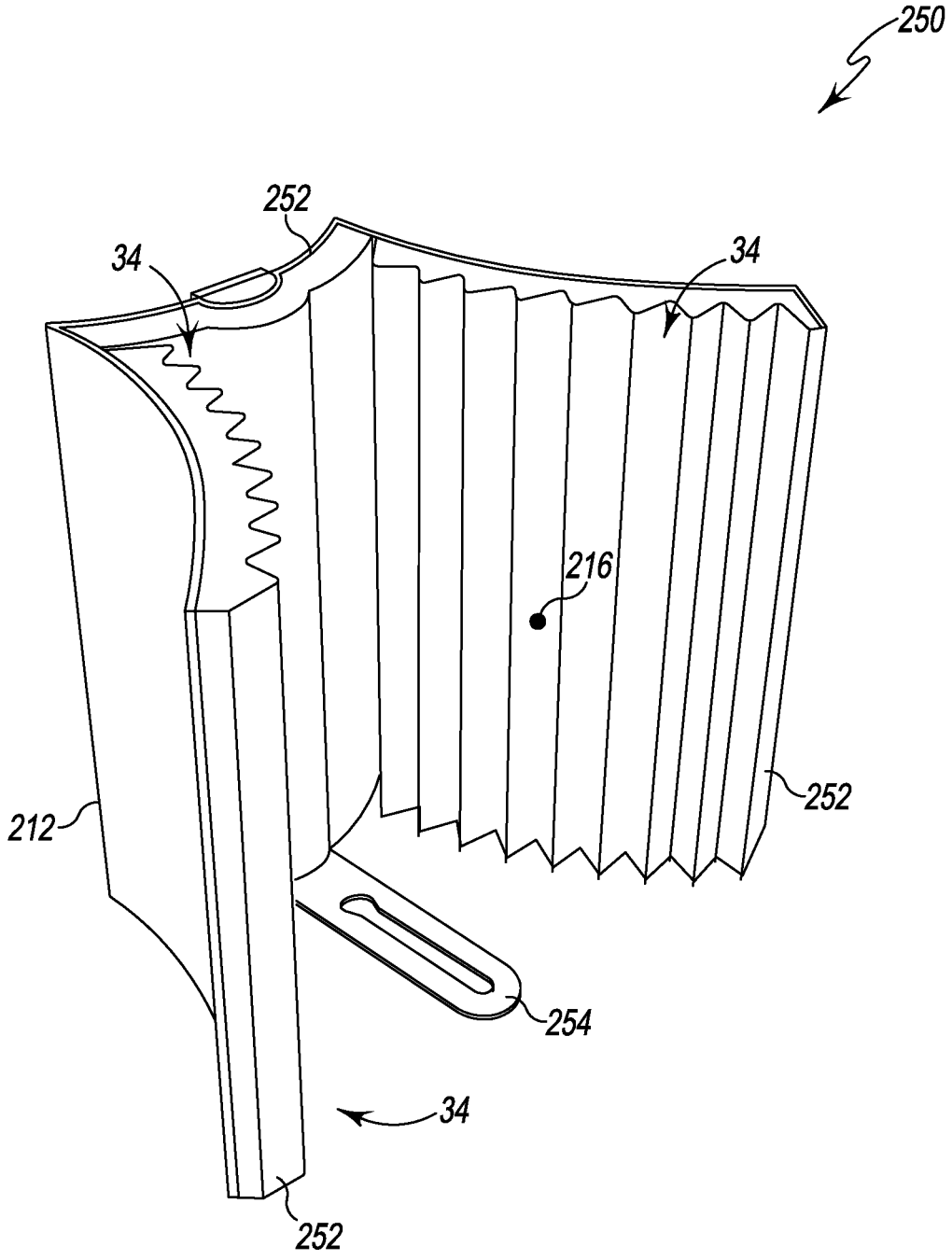
FIG. 6 illustrates a perspective view of another embodiment of the microphone shield.

Referring now to FIGS. 6-11, another embodiment of the microphone shield 250 is shown. The microphone shield 250 includes features similar to those described above in regard to the shield 210. Accordingly, the reference numbers used above in regard to the shield 210 will be used to describe the same or similar features of the shield 250. As shown in FIG. 6, the microphone shield 250 has a shell 212 and a number of acoustic liners 252 that are positioned around a point 216. The microphone shield 250 also includes a mounting bracket 254 secured to the bottom of the shell 212. The bracket 254 is configured to be secured to a stand or support positioned near a microphone (not shown) located at the point 216.

In the illustrative embodiment, the shell 212 is formed as a single monolithic component from a rigid plastic material.

It should be appreciated that in other embodiments the shell may be formed as separate pieces that are later assembled and may be formed from other materials including, for example, hardwoods. Each acoustic liner 252 is made of an acoustically absorbent material, such as, for example, open cell polyurethane foam, or a layer of nonwoven polyester fibers. As described in greater detail below, each of the liners 252 of the microphone shield 250 has a different geometric profile 34.

Figure 7:
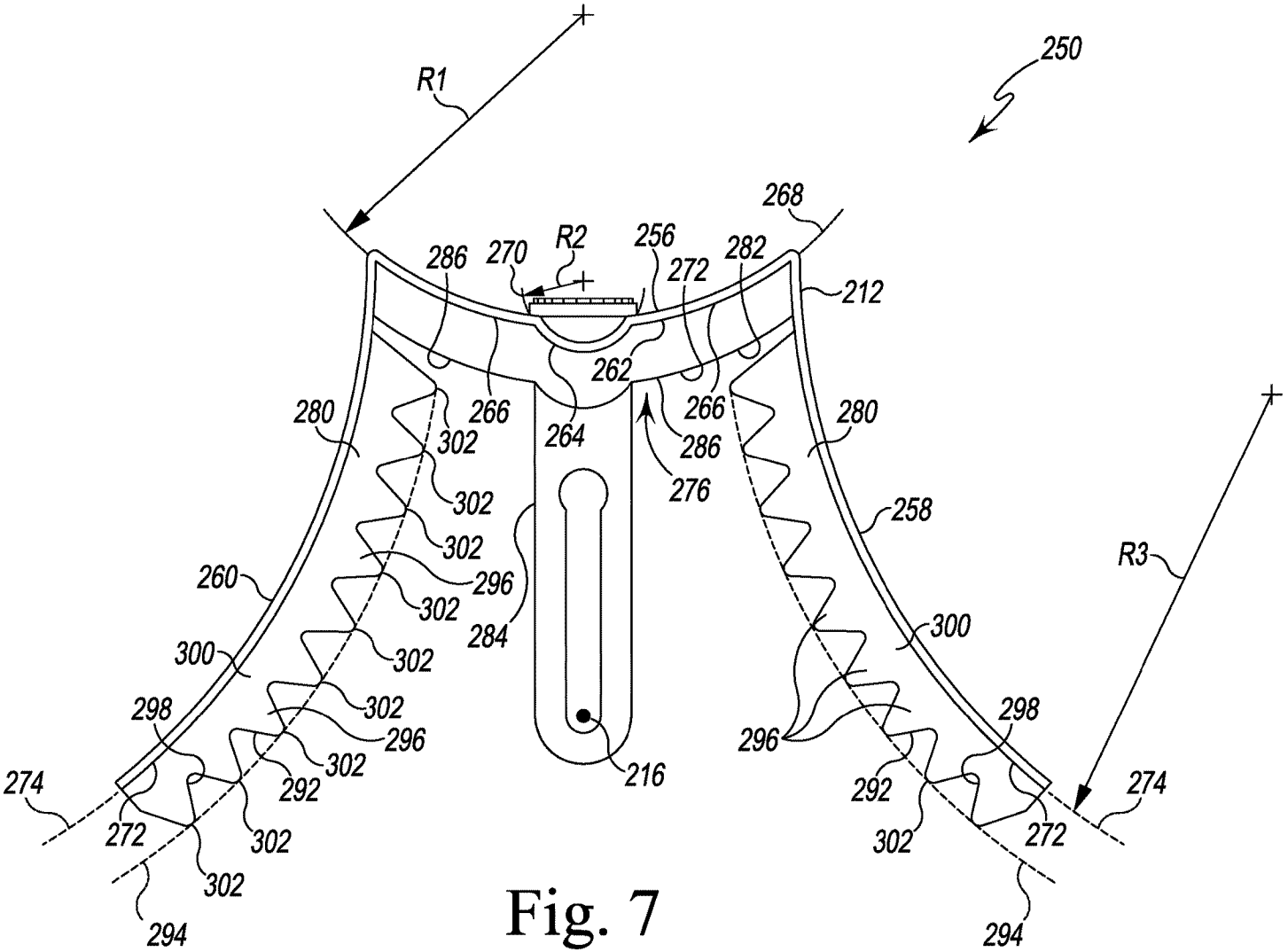
FIG. 7 illustrates a top plan view of the microphone shield of FIG. 6.
Figure 8:
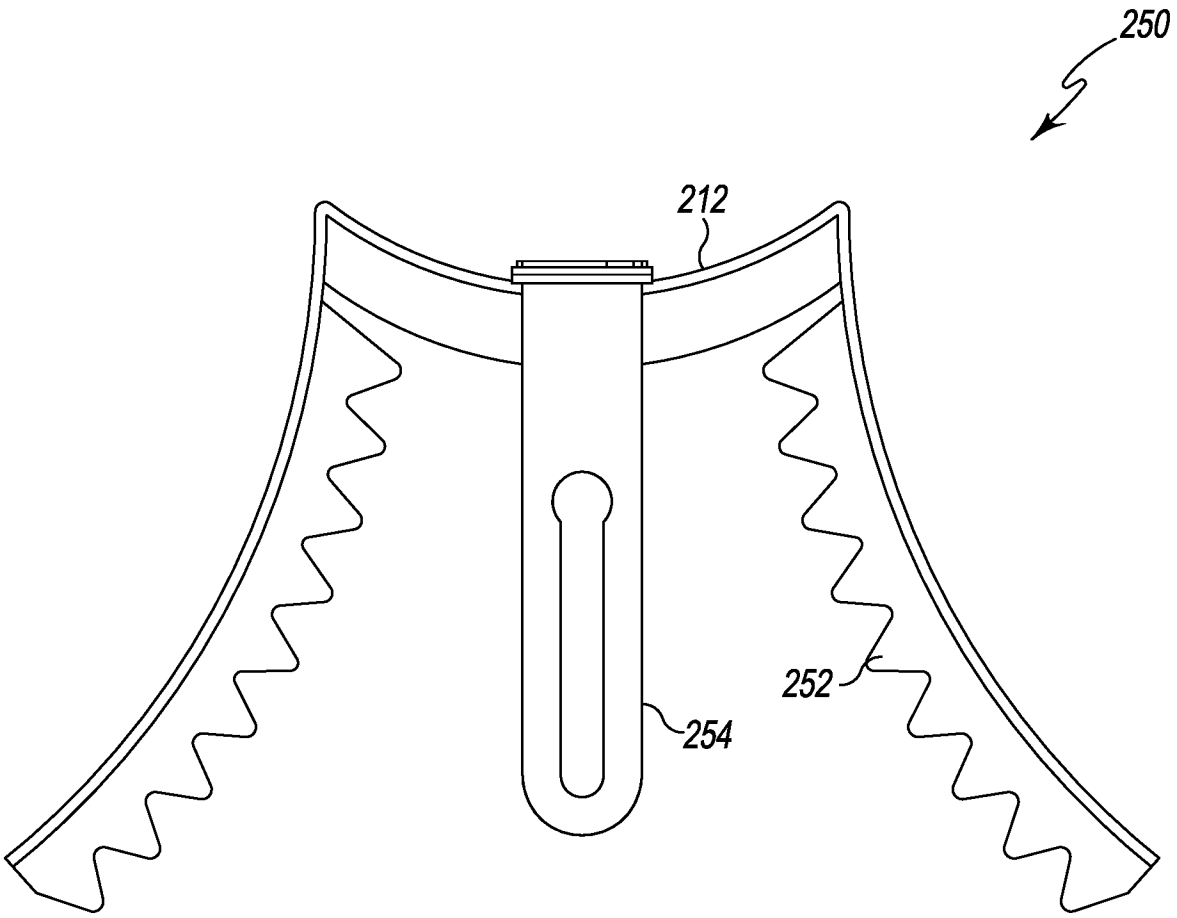
FIG. 8 illustrates a bottom plan view opposite the top plan view of FIG. 7.
Figure 9:
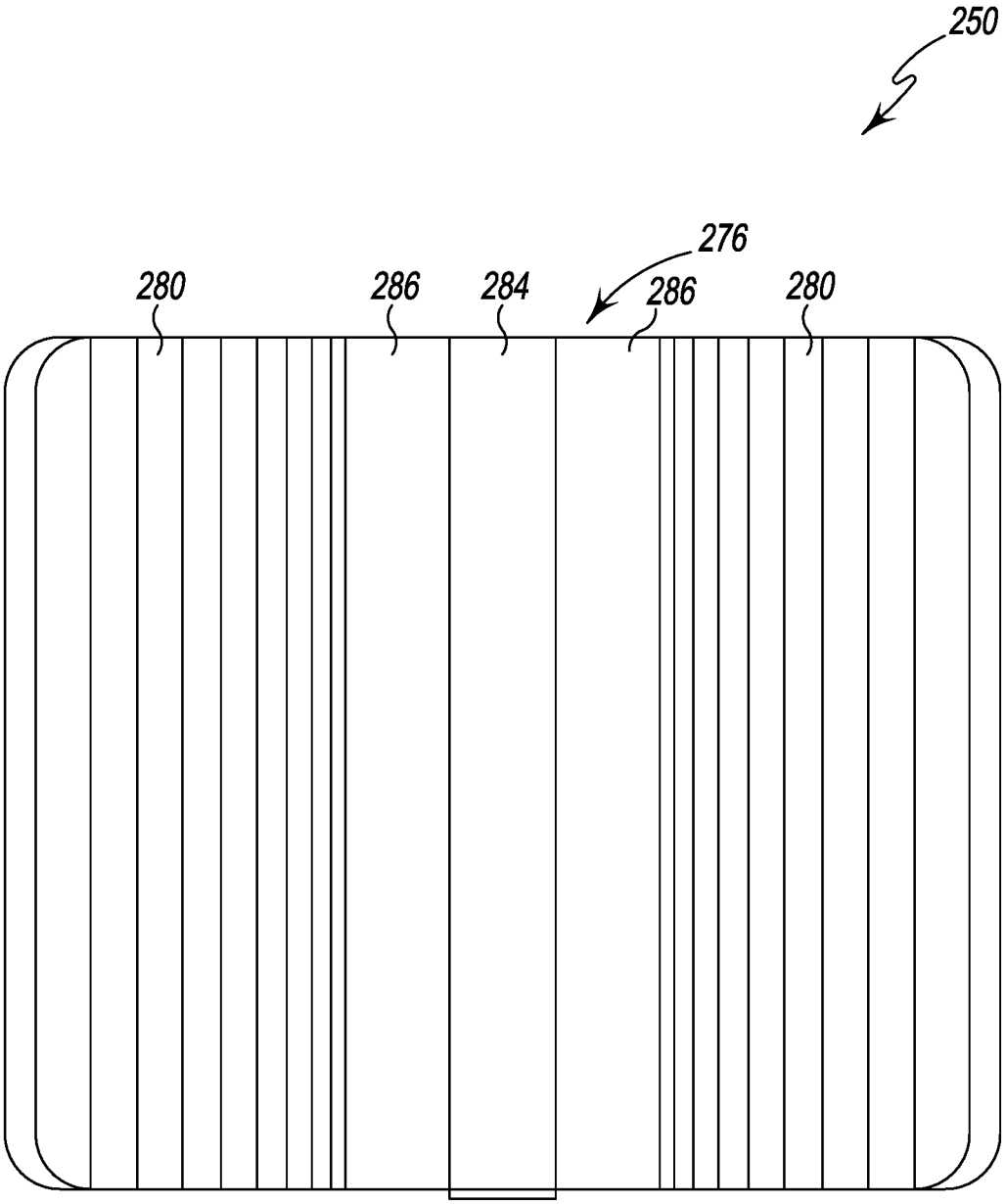
FIG. 9 illustrates a front elevation view of the microphone shield of FIG. 6.
Figure 10:
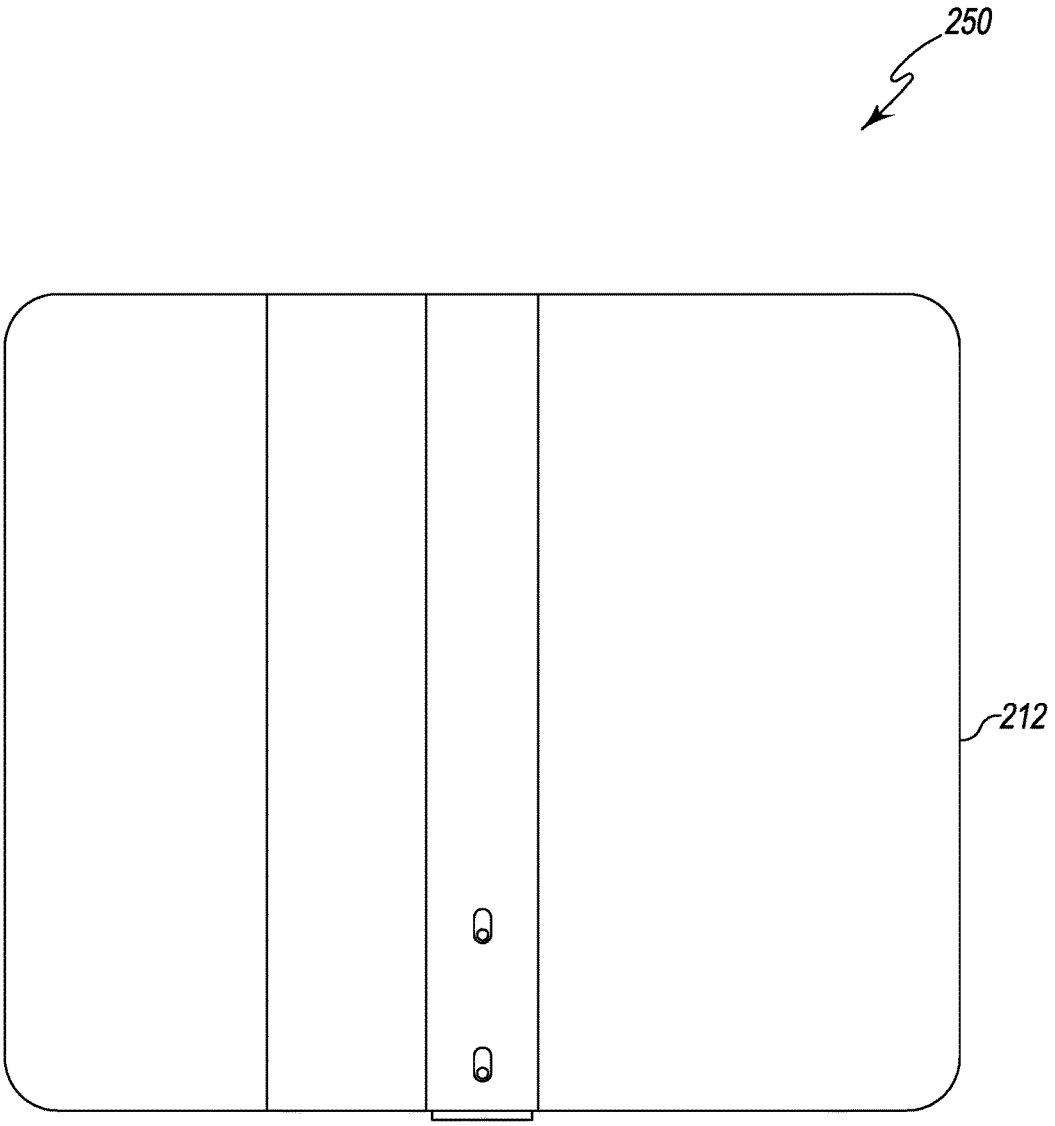
FIG. 10 illustrates a rear elevation view of the microphone shield of FIG. 6.
Figure 11:
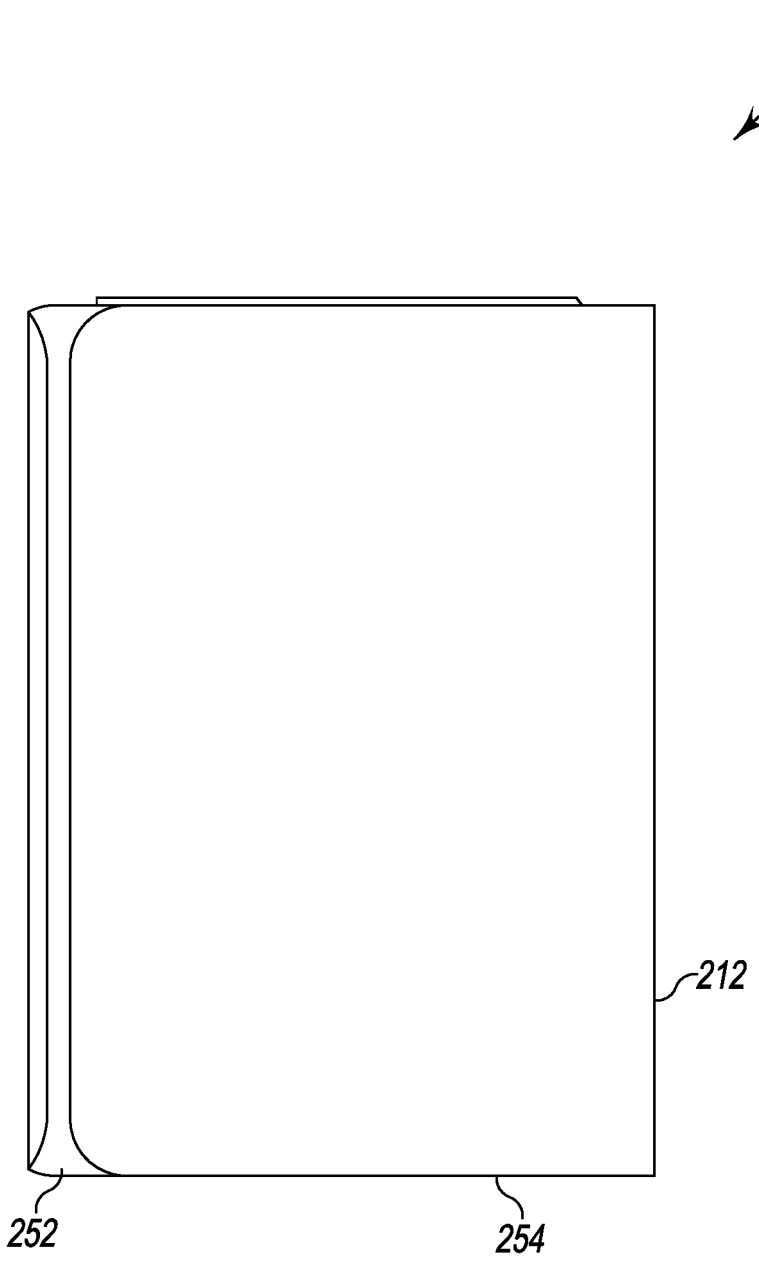
FIG. 11 illustrates a side elevation view of the microphone shield of FIG. 6, with the opposite side elevation view being the mirror image of FIG. 11.

Referring now to FIG. 7, the shell 212 includes a central panel 256 and a pair of side panels 258, 260 positioned on either side of the panel 256. The central panel 256 has an inner surface 262 that faces toward the point 216. In the illustrative embodiment, the inner surface 262 is a convex curved surface that is bowed toward the point 216. The surface 262 includes a central section 264 that is positioned between a pair of side sections 266. The sections 266 cooperate to define a curved arc 268 that has a convex shape relative to the point 216. The central section 264 defines another curved arc 270 that also has a convex shape relative to the point 216. As shown in FIG. 7, the curved arc 268 has a radius of curvature R1, and the curved arc 270 has a radius of curvature R2 that is less than the radius R1. In the illustrative embodiment, R2 is equal to about 1.0 inches, and R1 is equal to about 6.0 inches. It should be appreciated that in other embodiments the dimensions of R1, R2 may be different depending on, for example, the size and type of microphone.

The side panel 258 of the shell 212 is connected to one end of the central panel 256. In the illustrative embodiment, the side panel 260 of the shell 212 is connected to the opposite end of the central panel 256 and has a configuration that is the mirror image of the side panel 258. Each of the side panels 258, 260 has an inner surface 272 that faces toward the point 216, and the inner surface 272 of each of the panels 258, 260 is a convex surface that is bowed toward the point 216. As shown in FIG. 7, each inner surface 272 defines a curved arc 274 that also has a convex shape relative to the point 216. The curved arc 274 has a radius of curvature R3 in the illustrative embodiment. In the illustrative embodiment, R3 is equal to about 12 inches. It should be appreciated that in other embodiments the dimension of R3 may be different depending on, for example, the size and type of microphone.

In the illustrative embodiment, an acoustic liner 214 is attached to each of the panels 256, 258, 260. The liners 214 include a central liner 276 attached to the panel 256 and a pair of side liners 278, 280 attached to the side panels 258, 260, respectively.

The central liner 276 has an inner surface 282 that faces toward the point 216. In the illustrative embodiment, the inner surface 282 is a convex curved surface that is bowed toward the point 216. The surface 282 includes a central section 284 that is positioned between a pair of side sections 286. The sections 284, 286 cooperate to define the geometric profile 34 of the liner 276. The sections 286 define a curved arc 288 that has a convex shape relative to the point 216. The central section 284 defines another curved arc 290 that also has a convex shape relative to the point 216. In the illustrative embodiment, the curved arc 288 has the radius of curvature R1 (the same as the curved arc 268 defined by the surface sections 266 of the panel 256), and the curved arc 290 has the radius of curvature R2 (the same as the curved arc 270 defined by the surface 264 of the panel 256).

The side liner 278 of the shield 250 is positioned at one end of the central liner 276 on the panel 258. In the illustrative embodiment, the other side liner 280 is positioned at the opposite end of the central liner 276 on the panel 260 and has a configuration that is the mirror image of the side liner 278. Each of the side liners 278, 280 has an inner surface 292 that faces toward the point 216, and the inner surface 292 of each of the liners 278, 280 is bowed toward the point 216. As shown in FIG. 7, each inner surface 292 defines a curved arc 294 that also has a convex shape relative to the point 216.

In the illustrative embodiment, the geometric profile 34 of the liners 278, 280 is defined by a number of triangles 296. Each triangle 296 extends from a base 298 attached to a liner body 300 to a tip 302. The tips 302 cooperate to define the curved arc 294, as shown in FIG. 7. The curved arc 294 has the radius of curvature R3 in the illustrative embodiment.

In other embodiments, the acoustic liners may include number of different geometric profiles, such as, for example, a series of triangles extending across the width of an acoustic liner, a series of semi-circles extending the height of an acoustic liner, a series of squares extending the height of an acoustic liner, a series of pyramids repeating across the area of an acoustic liner, a series of squares repeating in a checkered pattern across the area of an acoustic liner, where a first square extends a first height away from a support and a second square extends a second height away from the support, such that the first height is different than the second height.

In the illustrative embodiment of FIGS. 6-11, the mounting bracket 254 extends outwardly from the shell 212. When attached to a stand or support, the bracket 254 is configured to extend generally parallel to the ground. As shown in FIGS. 6-9, the inner surfaces 272, 282 of the liners 252 extend in a generally perpendicular or orthogonal direction relative to the mounting bracket 254. It should be appreciated that in other embodiments the surfaces 272, 282 may be, for example, curved or angled relative to the mounting bracket 254 (and/or the ground).

Figure 12:
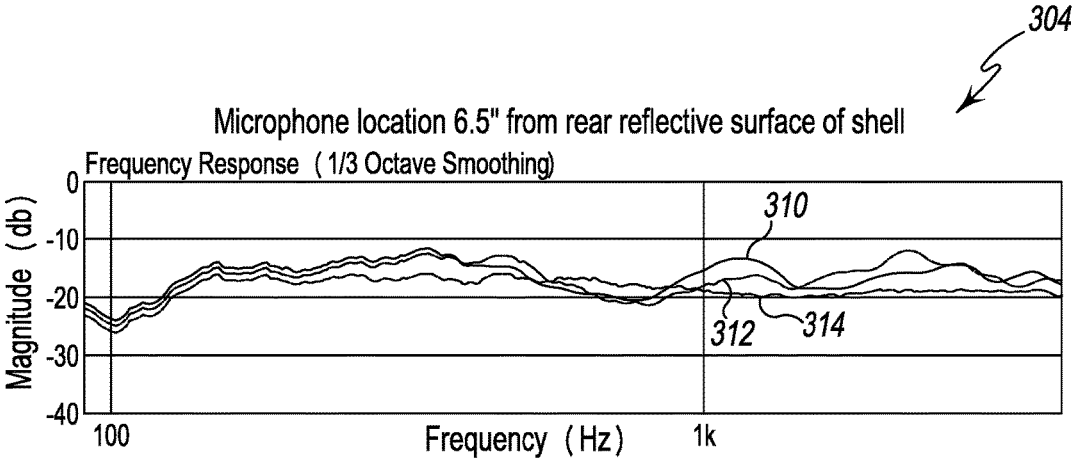
FIGS. 12-14 are simplified graphs showing the frequency responses of sound energy reflected from various microphone shield shells and detected by an omni-directional microphone.
Figure 13:
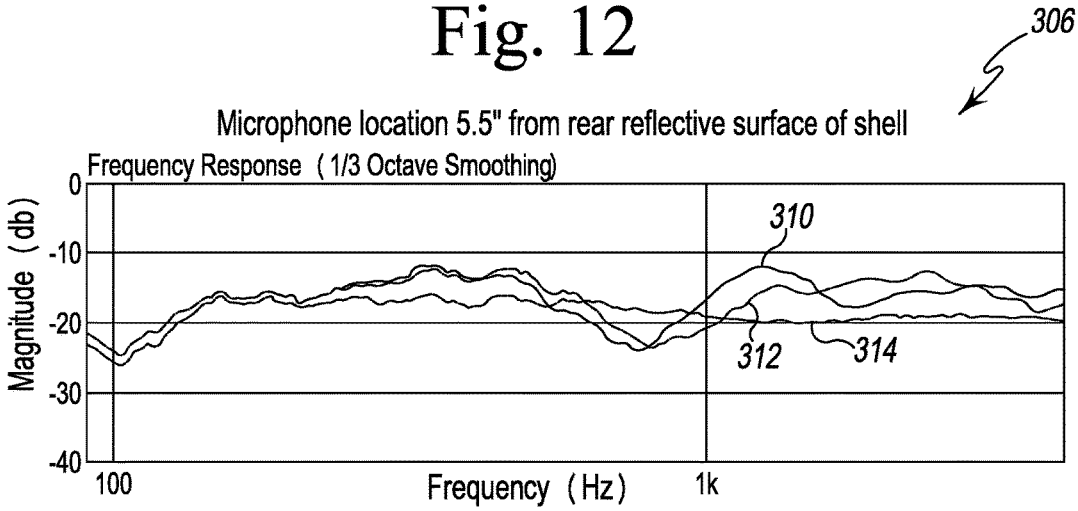
Figure 14:
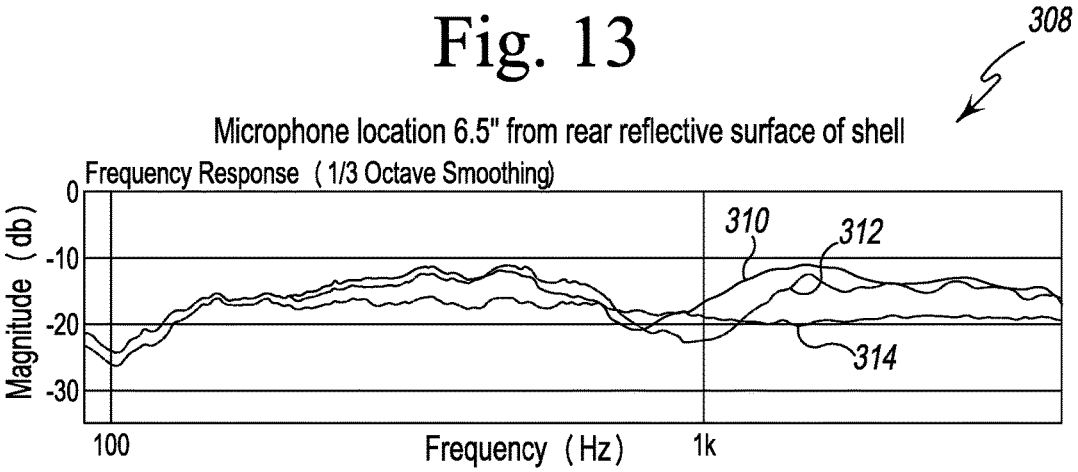
Figure 23:
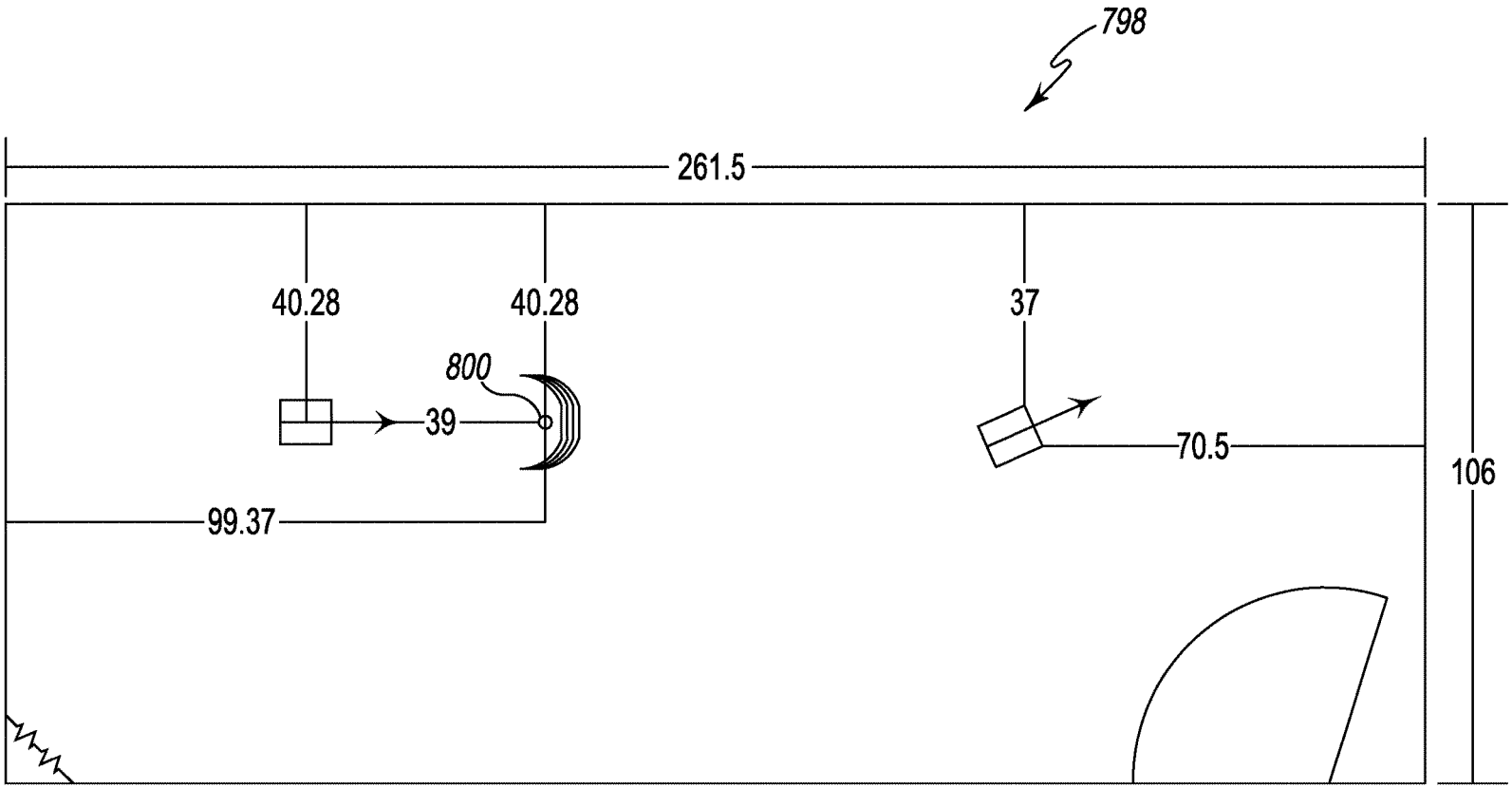
FIG. 23 is a simplified diagrammatic top plan view of a testing room used to test the sound absorptive properties and the sound reflective properties of one or more microphone shields.
Figure 24:
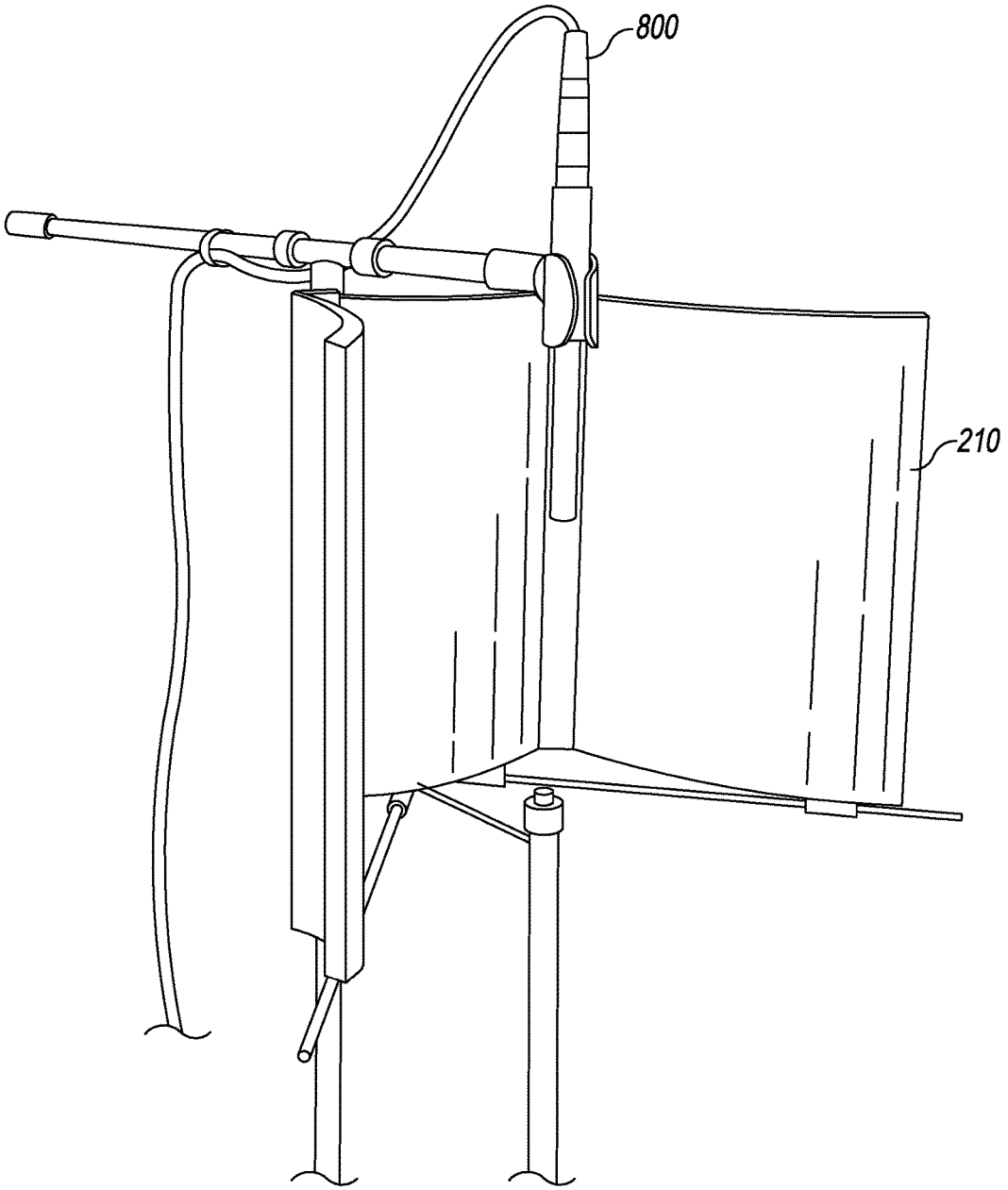
FIG. 24 is a perspective view of an unlined microphone shield shell with an omni-directional microphone positioned at a central point.

Referring to FIGS. 12-14, three graphs 304, 306, 308 of frequency responses of reflected sound energy received by an omni-directional microphone are shown. An exemplary test room 798 is shown in diagrammatic form in FIG. 23, with the microphone 800 positioned adjacent the microphone shield under test. An exemplary omni-directional microphone 800 with the microphone shield 210 is shown in FIG. 23. Returning to FIGS. 12-14, the line 310 represents the frequency response of reflected sound energy received by an omni-directional microphone when a prior art microphone shield, the Mudguard™, which is commercially available from Auralex Acoustics, is used to protect the microphone with the liner removed. The line 312 represents the frequency response of reflected sound energy received by the omni-directional microphone when the microphone shield 210 having panels with convex-shaped surfaces 226 and no acoustic liner is used to protect the microphone from sound energy reflections. The line 314 represents the frequency response of reflected sound energy received by the omni-directional microphone when no microphone shield is used to protect the microphone. All measurements are of sound energy reflected back to the microphone by the microphone shell. The lower the number, the less sound energy that is received by the microphone. As shown in FIGS. 12-14, the shield 210, even without an acoustic liner, tested better in low frequencies (below 400 Hz) where sound wavelength is harder to control and in mid-band frequencies (800-1500 Hz) where the human ear is the most sensitive.

Figure 15:
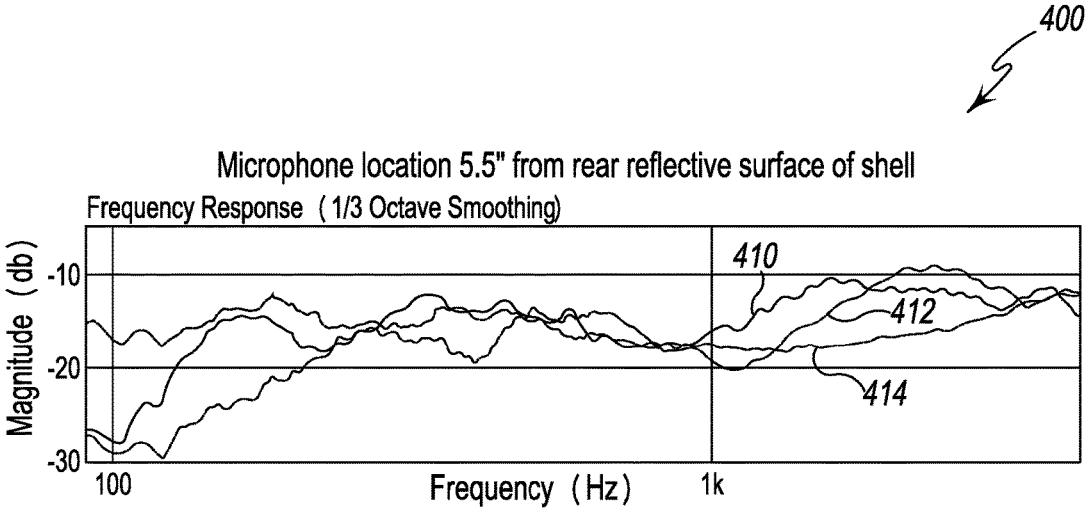
FIG. 15 is a simplified graph showing the frequency responses of sound energy reflected from various microphone shield shells and detected by a cardioid microphone.

Referring now to FIG. 15, a graph 400 of frequency responses of reflected sound energy received by a cardioid microphone 802 is shown. The line 410 represents the frequency response of reflected sound energy received by a cardioid microphone when a prior art microphone shield having no acoustic liner is used to protect the microphone from reflected sound energy. The line 412 represents the frequency response of reflected sound energy received by the cardioid microphone when the microphone shield 210 having panels with convex shaped second surfaces 226 and no acoustic liner is used to absorb internal reflections that might strike the microphone. The line 414 represents the frequency response of reflected sound energy received by the cardioid microphone when no microphone shield is used to protect the microphone. As shown in FIG. 15, the shield 210, even without an acoustic liner, tested better in low frequencies (below 500 Hz) where sound wavelength is harder to control and in mid-band frequencies (800-1750 Hz) where the human ear is the most sensitive.

Figure 16:
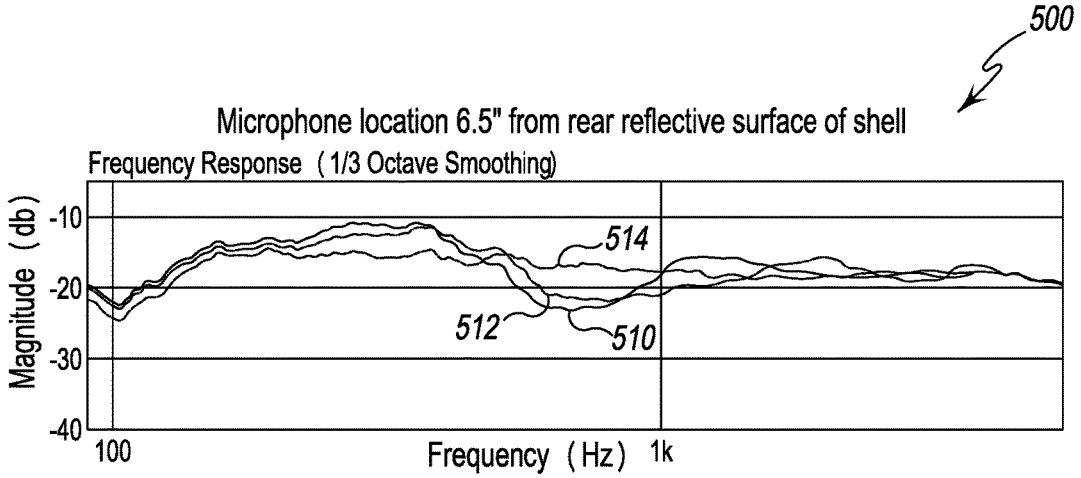
FIGS. 16-18 are simplified graphs showing the frequency responses of sound energy reflected from various microphone shield shells with acoustic liners and detected by an omni-directional microphone.
Figure 17:
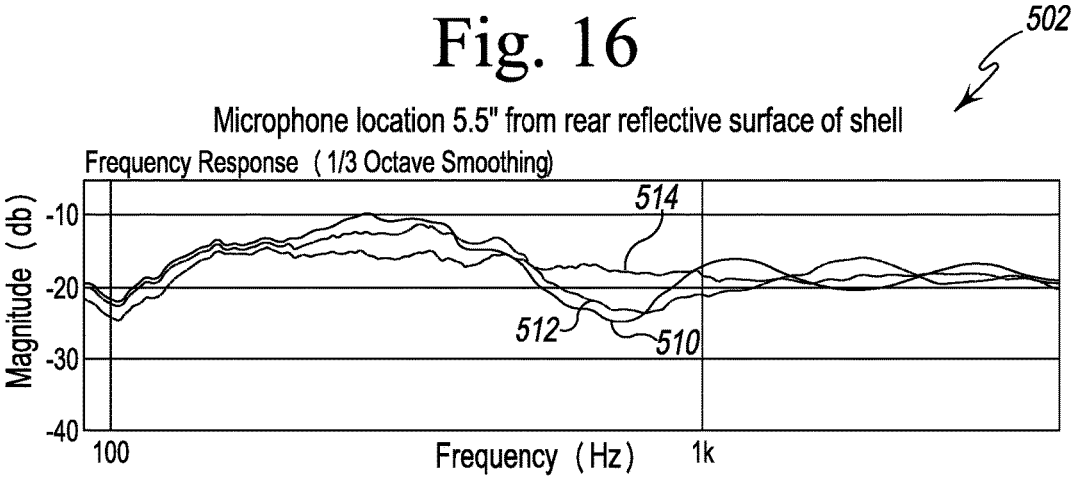
Figure 18:
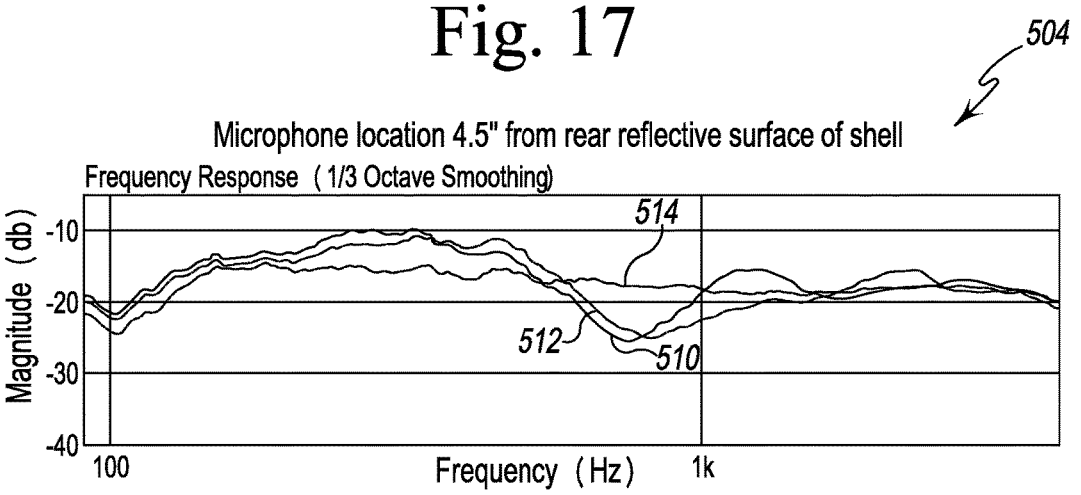
Figure 25:
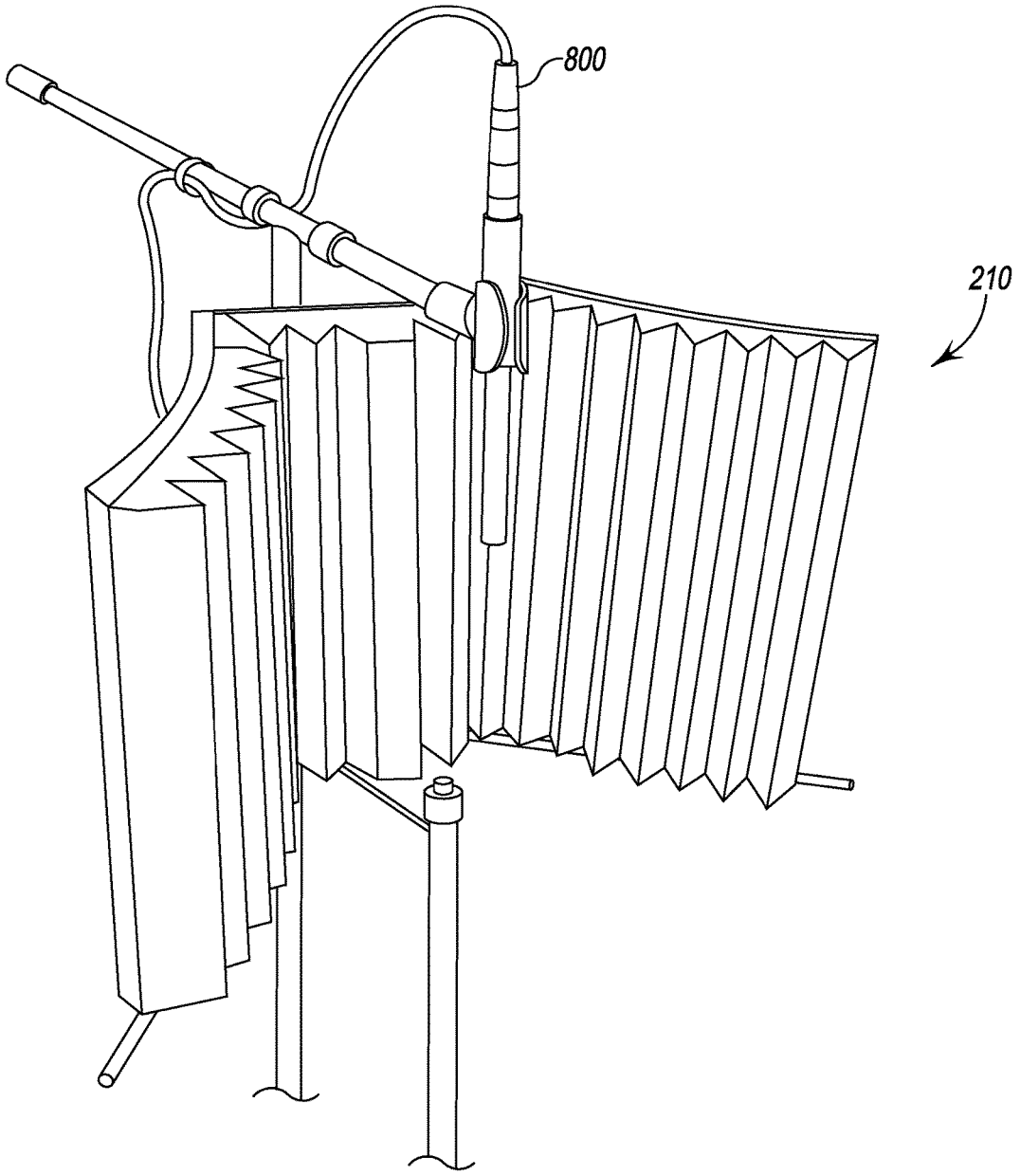
FIG. 25 is a perspective view of a microphone shield including an acoustic liner, with an omni-directional microphone positioned at a central point.

Referring now to FIGS. 16-18, three graphs 500, 502, 504 of frequency responses of reflected sound energy received by the microphone 800 are shown. The line 510 represents the frequency response of reflected sound energy received by the omni-directional microphone 800 when a prior art microphone shield, the Mudguard™, which is commercially available from Auralex Acoustics, including an acoustic liner is used to protect the microphone. The line 512 represents the frequency response of reflected sound energy received by the omni-directional microphone when the microphone shield 210 forming the convex arcs 240, 242, 244 is used, as shown in FIG. 25, to protect the microphone 800. The line 514 in FIGS. 16-18 represents the frequency response of reflected sound energy received by the omni-directional microphone when no microphone shield is used to protect the microphone. As shown in FIGS. 16-18, the shield 210 tested better in low frequencies (below 400 Hz) where sound wavelength is harder to control and in mid-band frequencies (800-1500 Hz) where the human ear is the most sensitive.

Figure 19:
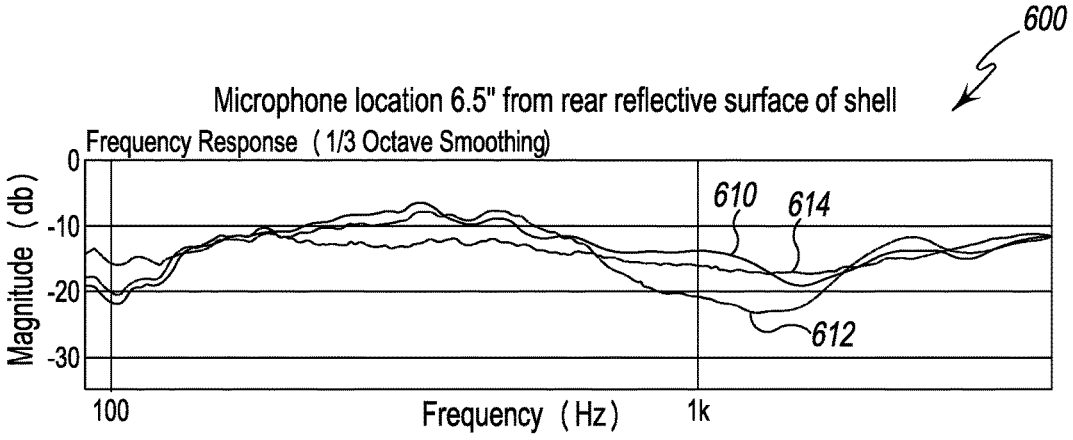
FIGS. 19-21 are simplified graphs showing the frequency responses of sound energy reflected from various microphone shield shells with acoustic liners and detected by a cardioid microphone.
Figure 20:
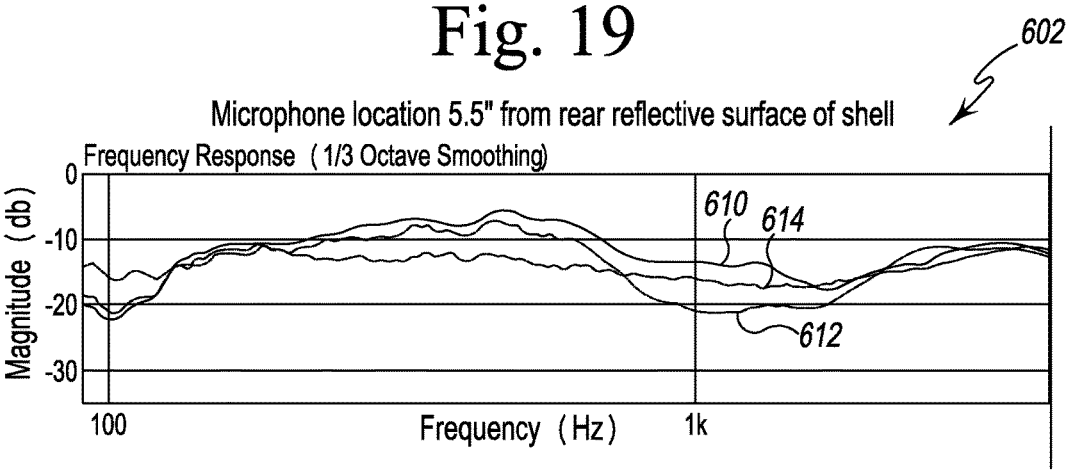
Figure 21:
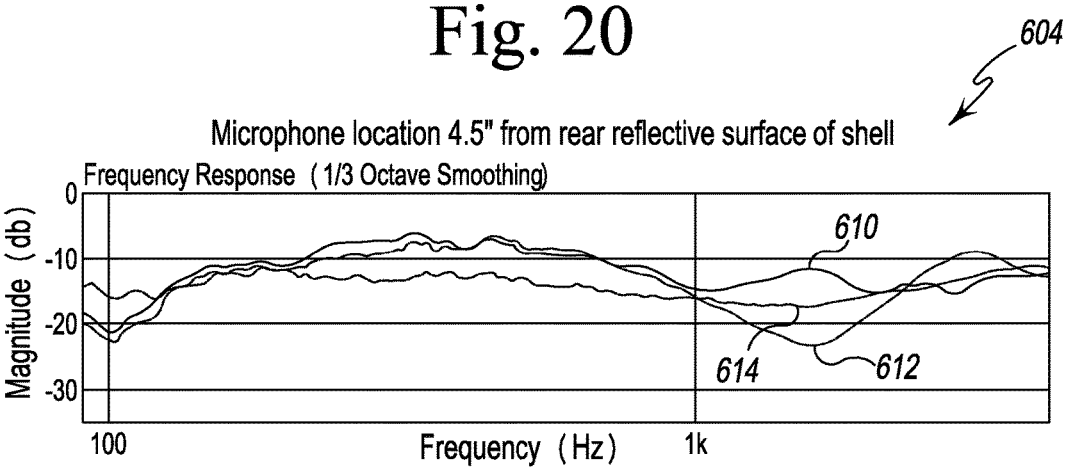
Figure 26:
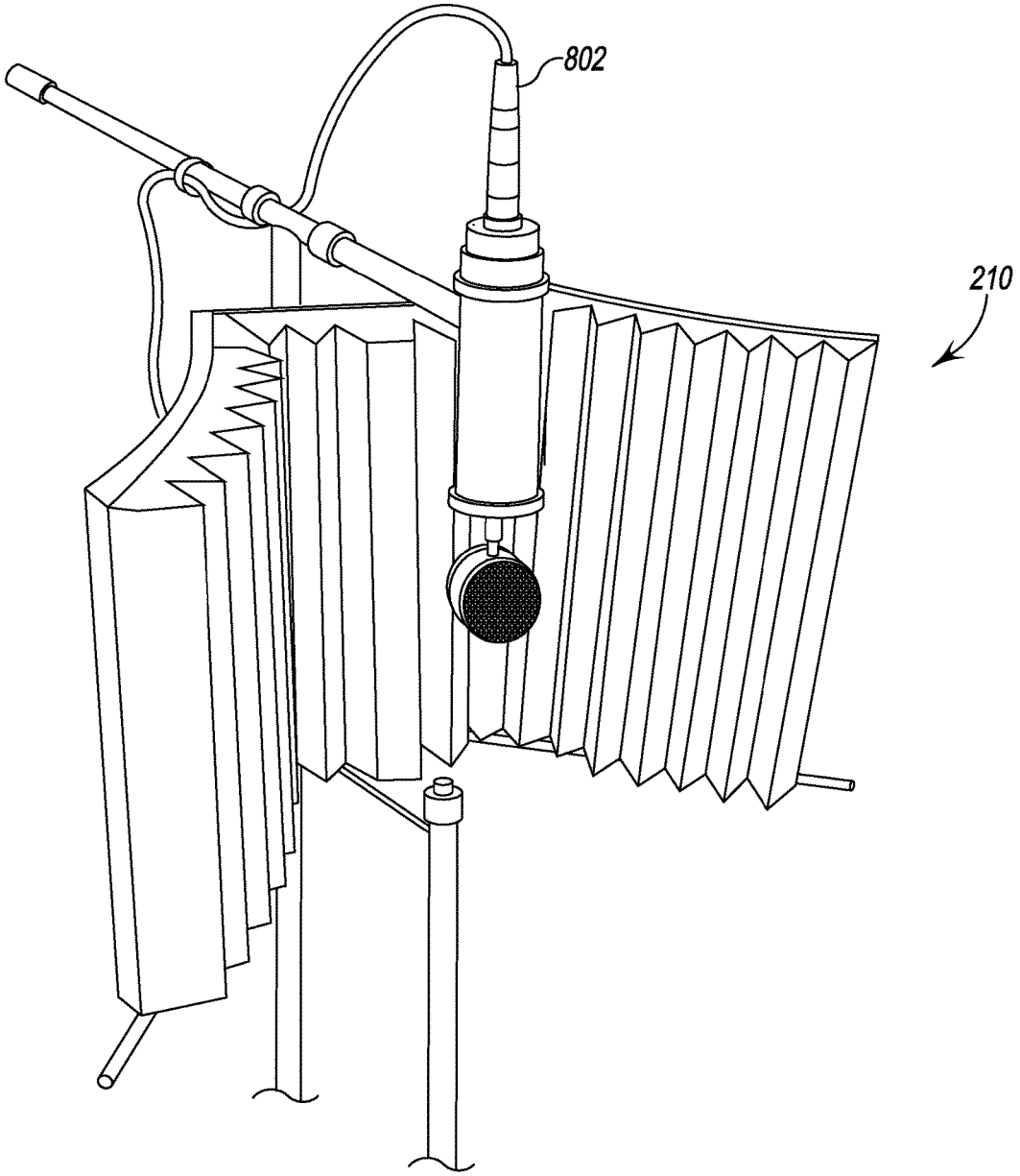
FIG. 26 is a perspective view of a microphone shield including an acoustic liner, with a cardioid microphone positioned at a central point.

Referring to FIGS. 19-21, three graphs 600, 602, 604 of frequency responses of reflected sound energy received by a cardioid microphone are shown. An exemplary microphone 802 positioned in the test arrangement of FIG. 23 is shown in FIG. 26. The line 610 in FIGS. 19-21 represents the frequency response of reflected sound energy received by the cardioid microphone 802 when a prior art microphone shield, the Mudguard™, which is commercially available from Auralex Acoustics, with an acoustic liner is used to protect the microphone. The line 612 represents the frequency response of reflected sound energy received by the cardioid microphone 802 when the microphone shield 210 forming the convex arcs 240, 242, 244 is used to protect the microphone, as shown in FIG. 26. The line 614 represents the frequency response of reflected sound energy received by the cardioid microphone when no microphone shield is used to protect the microphone. As shown in FIGS. 19-21, the shield 210 tested better in low frequencies (below 400 Hz) where sound wavelength is harder to control and in mid-band frequencies (700-2000 Hz) where the human ear is the most sensitive. It should be appreciated that the performance of other embodiments of the microphone shield described herein having at least one convex surface would have performance similar to the performance of the microphone shield 210 in the testing described above in reference to FIGS. 14-21.

Figure 22:
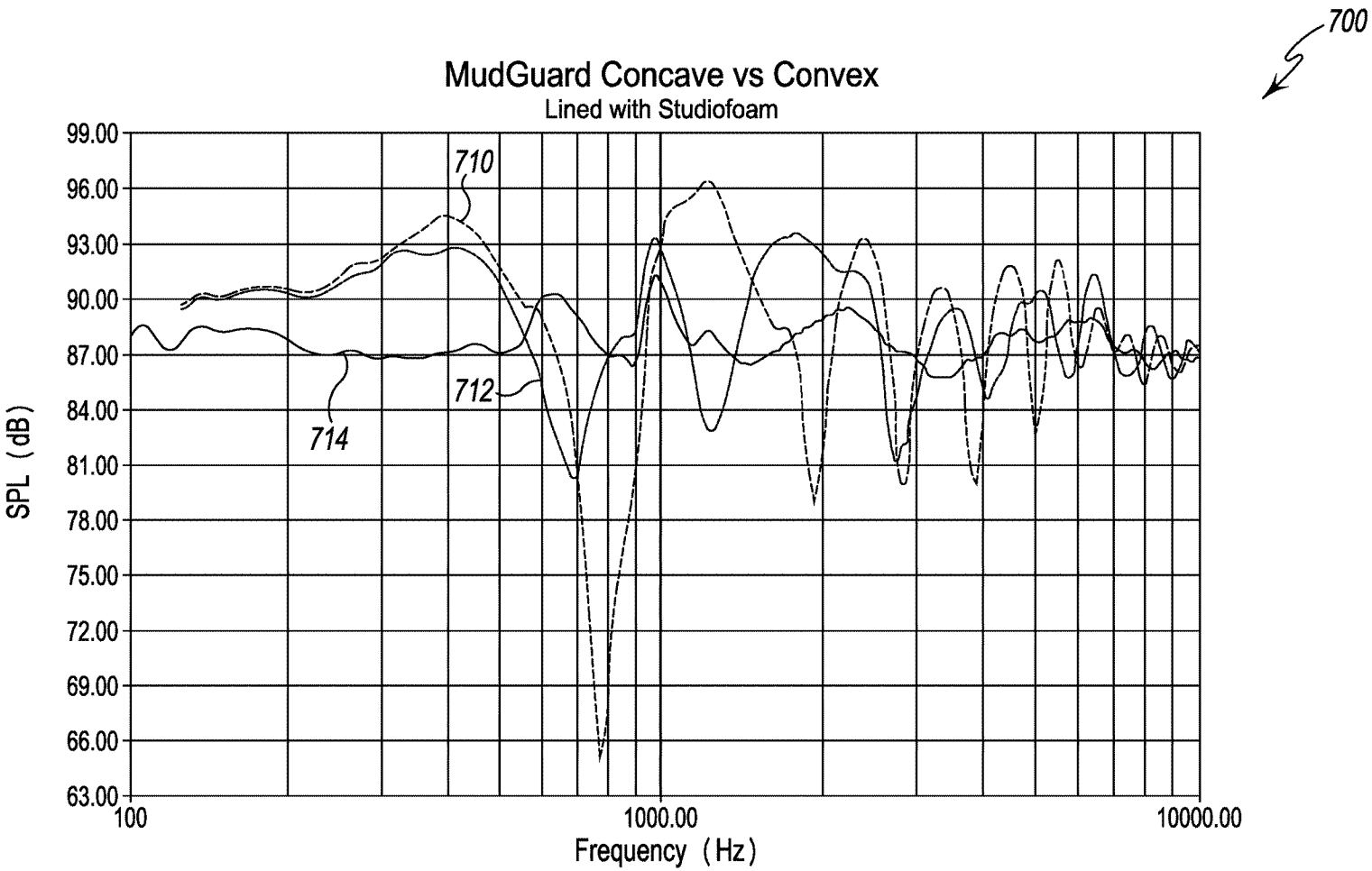
FIG. 22 is a simplified graph showing the frequency responses of sound energy reflected from various microphone shield shells and detected by a omni-directional microphone.

Referring now to FIG. 22, a graph 700 of frequency responses of reflected sound energy received by an omni-directional microphone 800 in an anechoic environment is shown. The line 710 represents the frequency response of reflected sound energy received by the omni-directional microphone 800 when a prior art microphone shield, the Mudguard™, which is commercially available from Auralex Acoustics, including an acoustic liner is used to protect the microphone. The line 712 represents the frequency response of reflected sound energy received by the omni-directional microphone when the microphone shield 250 is used to protect the microphone. The line 714 represents the frequency response of reflected sound energy received by the omni-directional microphone when no microphone shield is used to protect the microphone. As shown in FIG. 22, the shield 210 reflects less sound energy to the microphone 800 than the prior art design by deviating from the line 714 less than the line 710. It should be appreciated that the performance of other embodiments of the microphone shield described herein having at least one convex surface would have performance similar to the performance of the microphone shield 250 in an anechoic environment.

Figure 27:
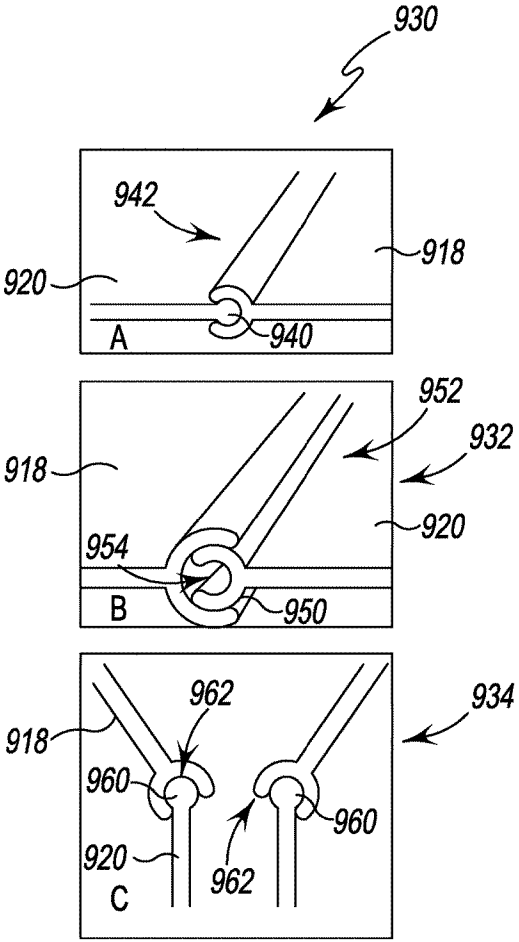
FIG. 27 illustrates an exploded perspective view of another embodiment of a microphone shield.
Figure 27:
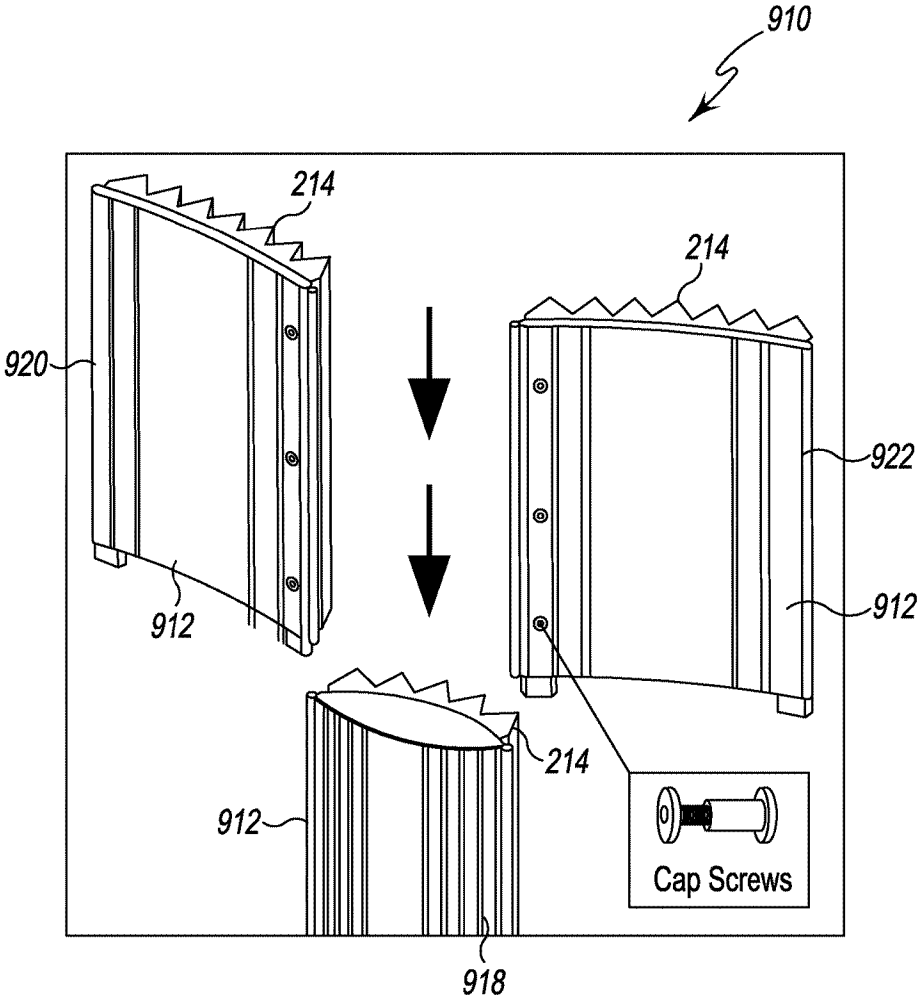
Figure 28:
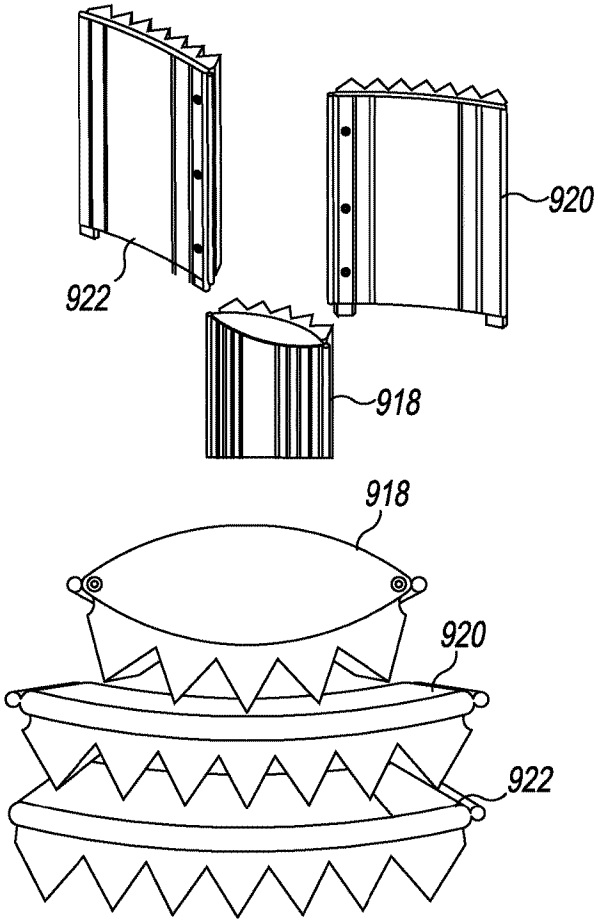
FIG. 28 illustrates a perspective view of the disassembled components of the microphone shield of FIG. 12A.
Figure 28:
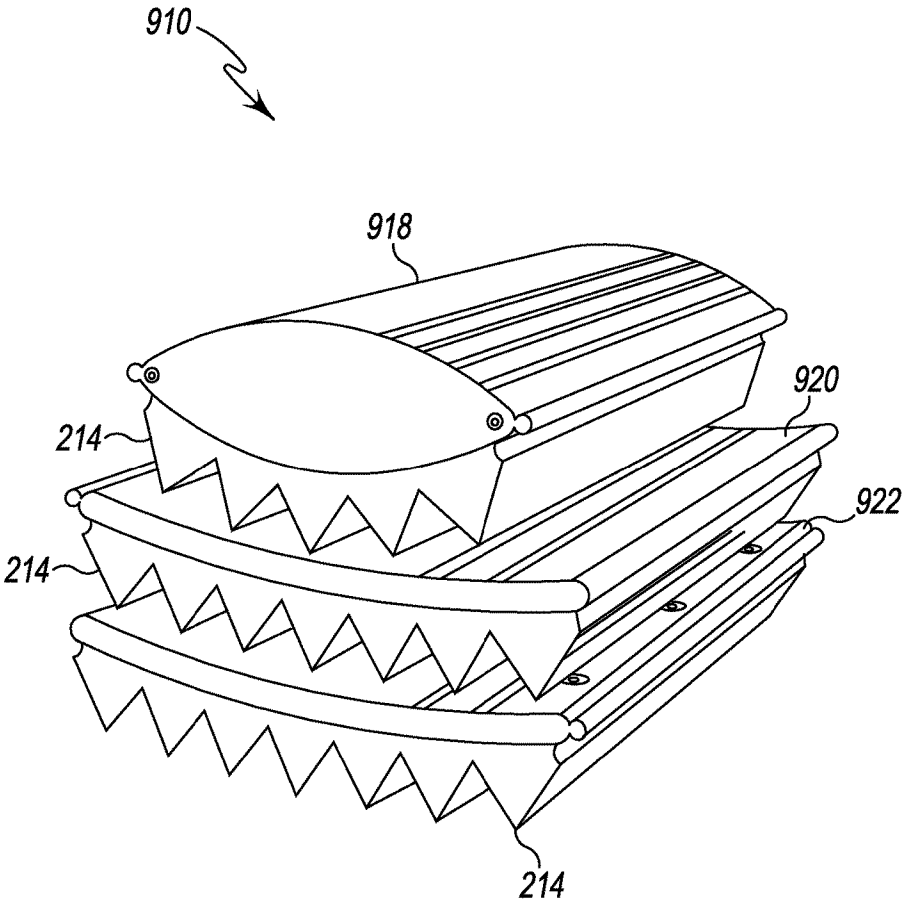

Referring now to FIGS. 27-28, another embodiment of a microphone shield 910 is shown. The microphone shield 910 includes features similar to those described above in regard to the shield 210. Accordingly, the reference numbers used above in regard to the shield 210 will be used to describe the same or similar features of the shield 910. As shown in FIG. 27, the microphone shield 910 has a shell 912 and a number of acoustic liners 214 that are positioned around a point 216. In the illustrative embodiment, the shell 912 is an assembly including multiple components, which may be disassembled as shown in FIG. 28 for transport.

As shown in FIG. 27, the shell 912 includes a central panel 918 that is configured to be secured to pair of side panels 920, 922. Each of the panels 918, 920, 922 are arced such that their second or inner surfaces 226 form a convex shape, relative to a point 216 (i.e., the microphone location). As shown in FIGS. 27A-C, various fastening mechanism 930, 932, 934 may be used to secure the panels 920, 922 to the panel 918 to form the shell 912. The fastening mechanism 930 of FIG. 27A includes an extruded flange 940 formed on one of the panels 920, 922 that is received in a groove 942 formed on the panel 918. The fastening mechanism 932 of FIG. 27B also includes an extruded flange 950 formed on one of the panels 920, 922 that is received in a groove 952 formed on the panel 918. As shown in FIG. 27B, the flange 950 includes another groove 954 sized to receive a plug (not shown) to create a "stop" and finished detail. The fastening mechanism 934 of FIG. 27C includes an extruded flange 960 formed on one of the panels 920, 922 that is received in a groove 962 formed on the panel 918. In the embodiment of FIG. 27C, the panel 918 may be rotated relative to the panels 920, 922 to disassemble the shield 910.

This new device shape, consisting of one or more panels with a convex shape (when viewed from the inside of the device) that shield the microphone on three sides (behind and to each side) to reduce the amount of internal reflections seen by the microphone. The convex shape of the panels will scatter or splay the reflected energy over a wider angle making the apparent size of the reflected surface smaller from the perspective of the microphone. The typical flat to concave shapes of all other devices will tend to focus or concentrate the internal reflected energy at the microphone increasing the amount of undesirable acoustical reflections at the microphones position.

Some features of a microphone shield may include making a shell of the microphone shield thicker to better block sound transmission and to control any structural resonances resulting from louder sound pressure levels. The shell may be made out of decorative thermoforming sheet materials, such as wood grain. Other features of the shell may include the shell having a carbon fiber look. In yet other embodiments, the shell is made from two-ply thermoformed sheet ABS and has a soft-feel plastic veneer. Rubber feet may be included to cover the integrated feet that my protrude from the edges of the bottom of the microphone shield panels to raise the microphone shield off of a supporting surface, when not stand is used, so as to accommodate cabling from the associated microphone and reduce the change of marring the finish of the supporting surface. In some embodiments, the microphone shield includes a holder to receive a computing device, such as a smartphone or tablet. In some embodiments, the holder is formed in the acoustic liner of the microphone shield.

In some embodiments, the microphone shield may include an extruded metal aluminum shell with a unique perforation pattern and hollow cavities to accept a supporting tubular microphone stand or to be filled with elastomeric polymers or foam material for resonance control. The shell may also include a stamped form with embossed or recessed areas, or attachable wood panels. The shell may also be made from a thermoformed shell sheet such as a single sheet made of a single material or a single sheet made of two materials (e.g., ABS and soft feel skin may have metal trim). The shell may also include decorative thermoforming single sheet materials (e.g., Kydex). The microphone shield may also be configured to have a carbon fiber look or a soft feel. The microphone shield may also include one or more hinges configured to provide angle adjustment between the panels of the microphone shield. In some embodiments, the microphone shield includes adjustable-height rubber feet.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected. Illustrative examples of the technologies disclosed herein are provided below. An embodiment of the technologies may include any one or more, and any combination of, the examples described below.

According to one example, a microphone shield comprises one or more panels positioned around a central point, and one or more acoustic liners coupled to each panel. Each of the one or more panels has a first surface facing away from the central point and a second surface facing toward the central point. The one or more acoustic liners is coupled to the second surface of each panel. Each of the one or more acoustic liners defines a geometric profile such that each acoustic liner extends from the second surface and terminates in one or more sound-absorbing surfaces. The sound-absorbing surface of at least one acoustic liner defines a curved arc that has a convex shape relative to the central point.

In some embodiments, the acoustic liners may comprise a central acoustic liner having the sound-absorbing surface that is bowed toward the central point to define the curved arc that is convex in shape relative to the central point, a first side acoustic liner positioned at a first end of the central acoustic liner, and a second side acoustic liner positioned at a second end of the central acoustic liner opposite the first end. The first side acoustic liner may have a sound-absorbing surface that defines a first curved arc, and the second side acoustic liner may have a sound-absorbing surface that defines a second curved arc.

In some embodiments, the sound-facing surfaces of the first side acoustic liner and the second side acoustic liner may have geometric profiles that are defined by a plurality of triangles, the tips of the triangles of the first side acoustic liner may define the first curved arc, and the tips of the triangles of the second side acoustic liner may define the second curved arc.

Additionally, in some embodiments, the sound-absorbing surface of the central acoustic liner may include a first curved section and a second curved section, and each of the first curved section and the second curved section may be defined by a first radius of curvature. A central curved section may connect the first curved section and the second curved section, and the central curved section may be defined by a second radius of curvature that is less than the first radius of curvature.

In some embodiments, the first curved arc and the second curved arc may be concave in shape relative to the central point. In some embodiments, the first curved arc and the second curved arc may be convex in shape relative to the central point.

In some embodiments, the sound-absorbing surface of the central acoustic liner may have a geometric profile that is defined by a plurality of triangles, and the tips of the triangle of the central acoustic liner may define the curved arc. In some embodiments, the one or more panels may include an arcuate panel and the second surface of the arcuate panel is bowed toward the central point.

Additionally, in some embodiments, the one or more panels may include a side panel extending from an end of the arcuate panel. The second surface of the side panel may extend along a substantially straight line. In some embodiments, the side panel may be a first side panel, and the one or more panels may include a second side panel extending from a second end of the arcuate panel. The second surface of the second side panel may extend along a substantially straight line.

In some embodiments, the acoustic liners may include a first side acoustic liner having a sound-absorbing surface that defines a substantially straight line extending parallel to the second surface of the first side panel, and a second side acoustic liner having a sound-absorbing surface that defines a substantially straight line extending parallel to the second surface of the second side panel.

Additionally, in some embodiments, the acoustic liners may further include a central acoustic liner coupled to the arcuate panel. The central acoustic liner may be positioned between the first and second side acoustic liners. The acoustic liner may have a sound-absorbing surface that is bowed toward the central point to define the curved arc that is convex in shape relative to the central point.

In some embodiments, the arcuate panel may be a central panel. The panels may include a first side arcuate panel positioned at a first end of the central panel and a second side arcuate panel positioned at a second end of the central panel opposite the first end. The second surfaces of the first side arcuate panel and the second side arcuate panel may be bowed toward the central point.

In some embodiments, the one or more panels may include a plurality of panels, and each panel may be removably coupled to at least one other panel.

According to another example, a microphone shield comprises one or more panels configured to curve around a central point and one or more acoustic liners coupled to the one or more panels. Each of the one or more panels has a first surface facing away from the central point a second surface facing toward the central point. The one or more acoustic liners are coupled to the second surface of each panel. Each of the one or more acoustic liners defines a geometric profile such that each acoustic liner extends from the second surface and terminates in one or more surfaces. The one or more surfaces of each acoustic liner is configured to define an arc that is convex in shape relative to the central point.

In some embodiments, the acoustic liners may comprise a central acoustic liner, a first side acoustic liner positioned at a first end of the central acoustic liner, and a second side acoustic liner positioned at a second end of the central acoustic liner opposite the first end. The first side acoustic liner may have a plurality of triangles and the tips of the triangles define one of the arcs that is convex in shape relative to the central point. The second side acoustic liner may have a plurality of triangles and the tips of the triangles define another of the arcs that is convex in shape relative to the central point.

According to another example, a microphone shield comprises a panel having a first surface facing away from a point and a second surface facing toward the point, and the second surface is configured to define a convex arc relative to the point. In some embodiments, the shield may further comprise an acoustic liner coupled to the second surface of the panel. The acoustic liner may have a panel-facing surface configured to couple to the second surface of the panel and a sound-absorbing surface configured to face toward the point. The sound-absorbing surface of the acoustic liner may be configured to define a convex curved arc relative to the point.

In some embodiments, the shield may further comprise a first side panel configured to be removably coupled to a first end of the panel, and a second side panel configured to be removably coupled to a second end of the panel. The panel, the first side panel, and the second side panel may be positioned around the point.

In some embodiments, the shield may further comprise a first side acoustic liner coupled to the first side panel and a second side acoustic liner coupled to the second side panel. The first side acoustic liner may have a surface that is bowed and configured to define a convex curved arc relative to the point. The second side acoustic liner may have a surface that is bowed and configured to define a convex curved arc relative to the point.

There exist a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A microphone shield, comprising:

a plurality of panels positioned around a central point, each of the panels having a first surface facing away from the central point and a second surface facing toward the central point, and an acoustic liner coupled to the second surface of each panel, each acoustic liner defining a geometric profile such that each acoustic liner extends from the second surface and terminates in one or more sound-absorbing surfaces, wherein the acoustic liners define a channel, the central point is positioned in the channel, and the acoustic liners comprise:

a central acoustic liner having the sound-absorbing surface that is bowed toward the central point, a first side acoustic liner positioned at a first end of the central acoustic liner, the first side acoustic liner having a sound-absorbing surface that is defined by a plurality of triangles, the tips of the triangles defining a first curved arc that is convex in shape relative to the central point, and a second side acoustic liner positioned at a second end of the central acoustic liner opposite the first end, the first side acoustic liner having a sound-absorbing surface that is defined by a plurality of triangles, the tips of the triangles defining a second curved arc that is convex in shape relative to the central point.

2. The microphone shield of claim 1, wherein the sound-absorbing surface of the central acoustic liner includes:

a first curved section and a second curved section, each of the first curved section and the second curved section being defined by a first radius of curvature, and a central curved section connecting the first curved section and the second curved section, the central curved section being defined by a second radius of curvature that is less than the first radius of curvature.

3. The microphone shield of claim 1, wherein the sound-absorbing surface of the central acoustic liner has a geometric profile that is defined by a plurality of triangles, and the tips of the triangle of the central acoustic liner define a curved arc.

4. The microphone shield of claim 1, wherein the panels include an arcuate panel and the second surface of the arcuate panel is bowed toward the central point.

5. The microphone shield of claim 4, wherein the panels include a side panel extending from an end of the arcuate panel, the second surface of the side panel extending along a substantially straight line.

6. The microphone shield of claim 4, wherein the arcuate panel is a central panel, the panels include a first side arcuate panel positioned at a first end of the central panel and a second side arcuate panel positioned at a second end of the central panel opposite the first end, the second surfaces of the first side arcuate panel and the second side arcuate panel being bowed toward the central point.

7. The microphone shield of claim 1, wherein the one or more panels include a plurality of panels, each panel being removably coupled to at least one other panel.

8. A microphone shield, comprising:

a plurality of panels configured to curve around a central point, each of the one or more panels having a first surface facing away from the central point a second surface facing toward the central point, and an acoustic liner coupled to the second surface of each panel, each acoustic liner defining a geometric profile such that each acoustic liner extends from the second surface to define an arc that is convex in shape relative to the central point, wherein the acoustic liners define a channel, the central point is position in the channel, and the acoustic liners comprise:

a central acoustic liner, a first side acoustic liner positioned at a first end of the central acoustic liner, the first side acoustic liner has a plurality of triangles and the tips of the triangles define a first curved arc that is convex in shape relative to the central point, and a second side acoustic liner positioned at a second end of the central acoustic liner opposite the first end, the second side acoustic liner has a plurality of triangles and the tips of the triangles define a second curved arc that is convex in shape relative to the central point.

9. The microphone shield of claim 8, wherein the central acoustic liner includes:

a first curved section and a second curved section, each of the first curved section and the second curved section being defined by a first radius of curvature, and a central curved section connecting the first curved section and the second curved section, the central curved section facing the central point and being defined by a second radius of curvature that is less than the first radius of curvature.

10. A microphone shield, comprising:

a plurality of acoustic liners including:

a central sound-absorbing liner that defines a convex base wall, a first side sound-absorbing liner positioned at a first end of the central acoustic liner, the first side sound-absorbing liner defining a first convex side wall, and a second side sound-absorbing liner positioned at a second end of the central acoustic liner, the second side sound-absorbing liner defining a second convex side wall, wherein the convex base wall, the first convex side wall, and the second convex side wall cooperate to define a central channel sized to receive a microphone.

11. The microphone shield of claim 10, wherein the central acoustic liner includes:

a first curved section and a second curved section of the convex base wall, each of the first curved section and the second curved section being defined by a first radius of curvature, and a central curved section of the convex base wall that connects the first curved section and the second curved section, the central curved section facing the central point and being defined by a second radius of curvature that is less than the first radius of curvature.

12. The microphone shield of claim 10, wherein each of the first convex side wall and the second convex side wall are defined by a plurality of triangles.

* * * * *